US007135823B2

(12) United States Patent
Suzuki et al.

(10) Patent No.: US 7,135,823 B2
(45) Date of Patent: Nov. 14, 2006

(54) IMAGE FORMING APPARATUS AND METHOD FOR DRIVING AND CONTROLLING THE SAME

(75) Inventors: Noritake Suzuki, Kanagawa (JP); Shigeki Yabu, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 200 days.

(21) Appl. No.: 10/954,206

(22) Filed: Oct. 1, 2004

(65) Prior Publication Data

US 2005/0264221 A1 Dec. 1, 2005

(30) Foreign Application Priority Data

Oct. 3, 2003 (JP) ..... 2003-346270

(51) Int. Cl.
*H05B 37/00* (2006.01)
*H01J 1/62* (2006.01)

(52) U.S. Cl. ..... 315/160; 315/169.1; 315/169.3; 315/169.4; 313/495; 313/306; 313/336; 313/351

(58) Field of Classification Search ..... 315/160, 315/169.1, 169.3; 313/495, 306, 336, 351, 313/292, 422, 497
See application file for complete search history.

(56) References Cited

U.S. PATENT DOCUMENTS

| | | | | |
|---|---|---|---|---|
| 6,225,749 | B1 | 5/2001 | Kobayashi et al. | 315/169.3 |
| 6,400,091 | B1 | 6/2002 | Deguchi et al. | 315/169.1 |
| 6,437,503 | B1 * | 8/2002 | Konuma | 313/495 |
| 6,445,367 | B1 | 9/2002 | Suzuki et al. | 345/75.2 |
| 6,472,813 | B1 * | 10/2002 | Mitsutake et al. | 313/495 |
| 6,534,924 | B1 | 3/2003 | Oguchi et al. | 315/169.1 |
| 6,975,288 | B1 * | 12/2005 | Nishimura et al. | 345/74.1 |
| 2003/0162465 | A1 | 8/2003 | Mizuno et al. | 445/24 |

FOREIGN PATENT DOCUMENTS

| | | |
|---|---|---|
| DE | 600 11 166 T2 | 9/2004 |
| EP | 1 037 250 A1 | 3/2000 |
| EP | 1 037 275 A1 | 9/2000 |
| EP | 1 037 250 B1 | 6/2004 |
| JP | 2000-243218 | 9/2000 |
| JP | 2000-251783 | 9/2000 |
| JP | 2000-268706 | 9/2000 |
| JP | 2002-100279 | 4/2002 |
| JP | 2003-031166 | 1/2003 |

* cited by examiner

*Primary Examiner*—Tho Phan
*Assistant Examiner*—Chuc Tran
(74) *Attorney, Agent, or Firm*—Fitzpatrick, Cella, Harper & Scinto

(57) ABSTRACT

An image forming apparatus comprising: a cathode; a gate; an anode; an electron emitting element arranged on the cathode; an image forming member that is arranged opposite to the electron emitting element; a deflection electrode that deflects the orbit of the electron emitted from the electron emitting element and headed toward the anode; and a driver, wherein assuming that an electric field required to start electron emission from the electron emitting element is Ee, that an electric field applied to the electron emitting element by applying voltage to the anode is Ea and that an electric field applied to the electron emitting element by applying voltage to the gate is Eg, the driver applies voltages to the cathode, the gate, and the anode in such a way that (i) Ea>Ee or (ii) Ea+Eg>Ee and Ea>Eg is satisfied.

12 Claims, 27 Drawing Sheets

PRIOR ART

IMAGE FORMING APPARATUS AND METHOD FOR DRIVING AND CONTROLLING THE SAME

BACKGROUND OF THE INVENTION

1. Field of the Invention

The present invention relates to an image forming apparatus that irradiates an image forming member with electrons emitted from an electron emitting element to form an image and in particular, to an image forming apparatus provided with an electron emitting element having such a threshold voltage to be applied to an anode that starts to cause electron emission.

2. Description of the Related Art

A field emission type (hereinafter referred to as "FE type") electron emitting device has been known as an electron emitting device. The application examples of this FE type electron emitting device include an electron source constructed of many FE type electron emitting devices arranged on a board and an image forming apparatus such as a flat panel display using the electron source. To realize an image forming apparatus like this, a board having an electron source formed thereon, a phosphor, and an anode are arranged in such a way that the phosphor and the anode are opposite to the board and electrons emitted from the electron emitting device are collided to the phosphor on the anode side to make the phosphor emit light.

A carbon base material that has a small work function for emitting electrons and a small threshold voltage receives attention as a material especially suitable for the electron emitting element of the electron emitting device. Examples using a carbon base material for an electron emitting element are disclosed in Japanese Patent Application Laid-Open (JP-A) No. 2000-243218 (specification of U.S. Pat. No. 6,437,503), JP-A Nos. 2000-251783, 2000-268706 (specification of U.S. Pat. No. 6,400,091), JP-A Nos. 2002-100279, and 2003-031166.

In these patent documents, fullerene, diamond, diamond like carbon (DLC), and carbon nano tube (CNT) are used as an electron emitting element.

One example of a method for driving an electron emitting device like this will be briefly described in the following.

FIG. 27A is a schematic view to show an electric potential distribution in a drive state where electrons are emitted and FIG. 27B is a schematic view to show an electric potential distribution in a state where electron emission is stopped. Here, FIG. 27 is a schematic view only to describe the content of the invention and the ratio of sizes of parts are not necessarily correct.

FIG. 27A shows a drive state where a voltage is applied to an anode 906 so as to make an electron emitting element 905 on a cathode 902 generate an electric field larger than a threshold electric field to start emitting electrons, thereby causing electron emission.

On the other hand, FIG. 27(*b*) shows a state where a negative voltage is applied to a gate 904 to make an electric field intensity in the vicinity of the electron emitting element 905 smaller than a threshold electric field required to emit electrons, thereby stopping the electron emission.

In this example, when the electron emission is stopped, as shown in FIG. 27(*b*), the electric potentials of the cathode 902 and the electron emitting element 905 are brought to 0 V and the electric potential of the gate 904 is brought to a negative value, so that it is clear that the gap between equipotential surfaces in the vicinity of the electron emitting element 905 becomes wide and that the electric field becomes small.

In this regard, the voltage applied to the gate 904 so as to stop the electron emission is determined by the threshold electric field of the electron emitting element 905, the electric field intensity by anode voltage, and designs such as the size of the electron emitting element 905, the distance between gate and cathode, and a gate size.

In a method for driving the electron emitting device described above, the electron emission is caused only by applying a voltage to the anode and a voltage of stopping electron emission is applied between the cathode and the gate to intercept the electron emission to control the electron emission. Hence, it is possible to drive and control the electron emitting device with ease and at low voltage.

By the way, in the case of a display to which the structure of the electron emitting device and the drive method described above are applied, an emitted electron is headed to the anode nearly directly above the electron emitting element. For this reason, there are cases where positive ions ionized by the electron beam fall onto the electron emitting element to have an effect on the life of the electron emitting device. Further, at the time of power being turned off, including an accidental power failure, there are cases where the entire surface of a display screen emits light until electric charges accumulated in the anode are discharged, which causes a user to feel abnormal.

Further at the time of power being turned on or off or power failure, there is easily brought an unstable state where a voltage sufficient large enough to stop electron emission from the electron emitting element can not be applied between the cathode and the gate. As a result, there are cases where a predetermined voltage is applied only between the cathode and the anode to cause the unintended light emission of the display screen, as described above. Hence, it is required to take measures against these problems.

SUMMARY OF THE INVENTION

Therefore, the present invention has been made to solve the above problems. In accordance with the first aspect of the invention, there is provided an image forming apparatus including: a cathode; a gate; an anode; an electron emitting element arranged on the cathode; an image forming member that is arranged opposite to the electron emitting element and headed toward the anode; and a driver, wherein assuming that an electric field required to start electron emission from the electron emitting element is Ee, that an electric field, applied to the electron emitting element by applying voltage to the anode is Ea and that an electric field applied to the electron emitting element by applying voltage to the gate is Eg, the driver applies voltages to the cathode, the gate, and the anode in such a way that (i) Ea>Ee or (ii) Ea+Eg>Ee and Ea>Eg is satisfied.

Further, in accordance with the second aspect of the invention, there is provided a method for driving an image forming apparatus including: a cathode; a gate; an cathode; an electron emitting element arranged on the cathode; an image forming member that is arranged opposite to the electron emitting element and is made to emit light by a collision of an electron, emitted from the electron emitting element by applying an electric field to the electron emitting element, to form an image; a deflection electrode that deflects an orbit of the electron emitted from the electron emitting element and headed toward the anode; and a driver, wherein assuming that an electric field required to start electron emission from the electron emitting element is Ee, that an electric field applied to the electron emitting element by applying voltage to the anode is Ea and that an electric field applied to the electron emitting element by applying voltage to the gate is Eg, the driver applies voltages to the cathode, the gate, and the anode in such a way that (i) Ea>Ee or (ii) Ea+Eg>Ee and Ea>Eg is satisfied, wherein when voltages for emitting the electron from the electron emitting element are applied to the cathode, the gate, and the anode, and/or when power supply is stopped, the deflection electrode deflects the orbit of the electron heading for the anode.

Still further, in accordance with the third aspect of the invention, there is provided a method for driving an image forming apparatus including: a cathode; a gate; an cathode; an electron emitting element arranged on the cathode; an image forming member that is arranged opposite to the electron emitting element and is made to emit light by a collision of an electron, emitted from the electron emitting element by applying an electric field to the electron emitting element, to form an image; a deflection electrode that deflects an orbit of the electron emitted from the electron emitting element and headed toward the anode; and a driver, wherein assuming that an electric field required to start electron emission from the electron emitting element is Ee, that an electric field applied to the electron emitting element by applying voltage to the anode is Ea and that an electric field applied to the electron emitting element by applying voltage to the gate is Eg, the driver applies voltages to the cathode, the gate, and the anode in such a way that (i) Ea>Ee or (ii) Ea+Eg>Ee and Ea>Eg is satisfied, wherein when voltages for emitting the electron from the electron emitting element are applied to the cathode, the gate, and the anode, and/or when power supply is stopped, a voltage for preventing the electron emission from the electron emitting element is applied to the deflection electrode.

Still further, in accordance with the fourth aspect of the invention, there is provided a method for driving an image forming apparatus including: a cathode; a gate; an anode; an electron emitting element arranged on the cathode; an image forming member that is arranged opposite to the electron emitting element and is made to emit light by a collision of an electron, emitted from the electron emitting element by applying an electric field to the electron emitting element, to form an image; and an electron intercepting member that prevents the electron emitted from the electron emitting element from reaching the image forming member, wherein when voltages for emitting the electron from the electron emitting element are applied to, the cathode, the gate, and the anode, a voltage of the same polarity as a voltage between the cathode and the anode is applied between the cathode and the electron intercepting member.

Still further, in accordance with the fifth aspect of the invention, there is provided a method for driving an image forming apparatus including: a cathode; a gate an anode; an electron emitting element arranged on the cathode; an image forming member that is arranged opposite to the electron emitting element and is made to emit light by a collision of an electron, emitted from the electron emitting element by applying an electric field to the electron emitting element to form an image; and an electron intercepting member which prevents the electron emitted from the electron emitting element from reaching the image forming member, wherein when voltages for emitting the electron from the electron emitting element are applied to the cathode, the gate, and the anode, and/or when power supply is stopped, an electric potential of the electron intercepting member is made a value at which the electron emitted from the electron emitting element is prevented from reaching the anode.

According to the invention, it is possible to reduce the deterioration of the electron emitting element that are caused by the collision of the ions and the abnormal light emission of the display that are caused by accumulated electric charges in the anode, as described above, and the like.

DETAILED DESCRIPTION OF THE PREFERRED EMBODIMENTS

The preferred embodiments of an image forming apparatus in accordance with the invention and a method for driving and controlling the same will be described by way of examples with reference to the drawings.

(First Embodiment)

Figure 1:
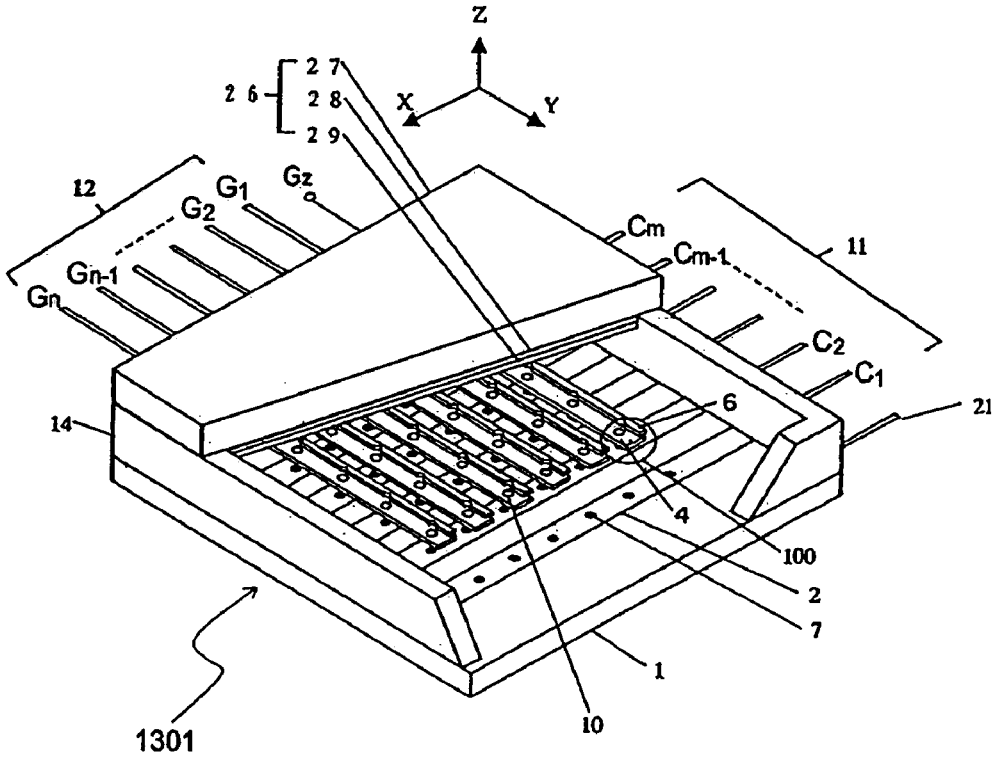
FIG. 1 is a perspective view of a display panel in accordance with the first embodiment of the present invention.

A display panel in accordance with the first embodiment of the invention will be described with reference to FIG. 1. Here, in the invention, an image forming apparatus is constructed of a display panel 1301 shown in FIG. 1 and a drive circuit connected to the display panel 1301, which will be described later. In FIG. 1, a reference numeral 1 denotes a board, 2 denotes a cathode, 4 denotes a gate, 6 denotes a deflection electrode for deflecting an electron beam, 7 denotes an electron emitting element, 10 denotes an opening, 11 denotes a wiring in X direction, 12 denotes a wiring in Y direction, 14 denotes an outside frame, 26 denotes a face plate, and 100 denotes an electron emitting device. The face plate 26 has an anode board 27 of a transparent board made of glass or the like, a fluorescent film 28 mounted as an image forming member on the anode board 27, and a metal back 29 arranged on the fluorescent film 28. The cathode 2 and the gate 4 are connected to external terminals, respectively. A first insulating layer 3, which will be described later, is interposed between the cathode 2 and the gate 4. Here, an opening is made in a portion of the first insulating layer 3 corresponding to the opening 10 of the gate 4. A second insulating layer 5, which will be described later, is interposed also between the gate 4 and the deflection electrode 6. Further, the deflection electrode 6 is connected to a power source for applying a deflection voltage Gz.

The metal back 29 is a conductive film and is formed of, for example, an aluminum film. A high voltage is applied to the metal back 29 to emit electrons and to accelerate them, so that the metal back 29 has a function as an anode. Here, the fluorescent film 28 of an image forming member is interposed between the metal back 29 of the anode and the board 27, but the metal back 29 may be interposed between the fluorescent film 28 and the anode board 27. However, in this case, it is preferable to use a transparent conductive film such as ITO as the metal back 29.

The metal back 29 is provided at a location, for example, 2 mm away from the cathode 2 and, for example, a voltage of 10 kV is applied to the metal back 29.

In FIG. 1, the wiring 11 in the X direction is constructed of m wirings shown by C1, C2, . . . , Cm. In an example shown in FIG. 1, the wiring 11 in the X direction also serves as the cathode 2 and is formed in the shape of stripes. Further, the wiring 12 in the Y direction is constructed of n wirings shown by G1, G2, . . . , Gn and also serves as the gate 4 and is formed in the shape of stripes.

These wirings are constructed of aluminum base material formed by a vapor deposition method or the like. The wirings are suitably designed in material, film thickness and width and are manufactured by a suitably selected method.

The electron emitting element 7 is formed on the stripe-shaped cathode 2 corresponding to the position of the electron emitting device 100. The stripe-shaped gate 4 has the opening 10 at a portion corresponding to the electron emitting element 7 on the cathode 2.

A scanning circuit (not shown) for applying a scanning signal to select the desired wiring 11 (cathode 2) in the X direction is connected to the wirings 11 in the X direction.

On the other hand, a modulation circuit (not shown) for modulating electrons emitted from each electron emitting device in response to an input signal is connected to each of the wirings 12 in the Y direction.

A voltage applied between the cathode 2 and the gate 4 of each electron emitting device corresponds to a difference voltage between a scanning signal applied to the cathode 2 (wiring 11 in the X direction) of the electron emitting device and an information signal applied to the gate 4 (wiring 12 in the Y direction) Here, when the electrons are not emitted in this embodiment, a positive voltage is applied to the cathode 2 (wiring 11 in the X direction) and a negative voltage is applied to the gate 4 (wiring 12 in the Y direction).

According to the above construction, a desired electron emitting device can be selected and be independently driven.

Here, the stripe shaped gate 4 and the opening 10 on the cathode 2 nearest to the front side are not shown for sake of convenient reference to the drawing.

The electron emitting device 100 arranged in the display panel 1301 in accordance with this embodiment will be described by use of schematic views shown in FIG. 4A and FIG. 4(*b*). FIG. 4(*a*) shows a sectional view of one electron emitting device. FIG. 4(*a*) shows also the state of equipotential surfaces 35 when the electron emitting element 7 emits electrons. FIG. 4(*b*) shows a plan view of the same electron emitting device. In the drawings, a reference numeral 1 denotes the board, 2 denotes the cathode, 3 denotes the first insulating layer, 4 denotes the gate, 5 denotes the second insulating layer, and 6 denotes the deflection electrode. A reference numeral 29 denotes a metal back connected to a high voltage power source. Here, the anode board 27 and the phosphor 28 shown in FIG. 1 are omitted in the drawing.

A method of controlling electron emission from each electron emitting device 100 in the image forming apparatus in accordance with this embodiment will be described in detail with reference to FIG. 4, FIG. 5, and FIG. 6.

FIG. 4(*a*) shows an electric potential distribution and an electron beam orbit in a drive state in which electrons are emitted from the electron emitting device (hereinafter referred to as "ON state"). FIG. 5 shows an electric potential distribution in a state in which electron emission is stopped (hereinafter referred to as "OFF state"). FIG. 6 shows timings of applying voltages to the gate 4 of the electron emitting device and the deflection electrode 6 and the response of electron emission to the applied voltages.

Here, assuming that an electric field required to start emitting electrons from the electron emitting element 7 (threshold electric field) is Ee, that an electric field applied to the electron emitting element 7 by applying voltage to the metal back 29 is Ea and that an electric field applied to the electron emitting element by applying voltage to the gate 4 is Eg, when the electrons are emitted from the electron emitting element 7, voltages are applied to the cathode 2, the metal back 29, and the gate 4 so as to satisfy (Ea>Ee) or (Ea+Eg>Ee and Eg<Ee).

The threshold electric field Ee is a minimum value of an electric field intensity where electron emission from the electron emitting element can be clearly recognized. Although the value of the threshold electric field Ee depends on the structure of the electron emitting device and the voltages applied to the respective electrodes, preferably, the threshold electric field Ee ranges from $10^4$ V/cm to $10^7$ V/cm. In a method for driving an electron emitting device of the invention, voltages are applied to the cathode 2, the metal back 29, and the gate 4 so as to satisfy (Ea>Ee) or (Ea+Eg>Ee) to emit electrons from the electron emitting element 7, thereby making the emitted electrons collide with the metal back 29 (fluorescent film 28).

A method for driving an image forming apparatus in accordance with the invention includes that, for example, when an image is displayed on the display panel of the image forming apparatus, in a case where the brightness of the display panel is low, a positive voltage is applied also to the gate 4 to increase the electrons reaching the metal back 29. However, at this time, voltages applied to the gate 4 and the metal back 29 are set in such a way that the electric field Ea by the metal back 29 is larger than the electric field Eg by the gate 4.

Further, in the invention, assuming that an electric field applied to the electron emitting element by applying voltage to the deflection electrode 6 is Eh, when the electrons are emitted from the electron emitting element 7, voltages may be applied to the cathode 2, the gate 4, the deflection electrode 6 and the metal back 29 in such a way that (Ea+Eh>Ee and Ea>Eh) or (Ea+Eg+Eh>Ee and Ea>Eg+Eh) is satisfied. The electric field applied to the electron emitting element 7, to be more precise, is a complex electric field determined by the voltage applied to each of the cathode 2, the gate 4, the deflection electrode 6, and the metal back 29, and a relative position and a shape. However, effectively, the electric fields in the present invention are defined as follows: Ea is a value obtained by dividing a voltage Va between the metal back 29 and the electron emitting element 7 by the shortest distance La between the metal back 29 and the electron emitting element 7; Eg is a value obtained by dividing a voltage between the gate 4 and the electron emitting element 7 (0 V in a case shown in FIG. 4) by the shortest distance Lg between the gate 4 and the electron emitting element 7; and Eh is a value obtained by dividing a voltage Vh between the deflection electrode 6 and the cathode 2 by the shortest distance Lh between the deflection electrode 6 and the electron emitting element 7. Here, in a case where the distance from the interface of the cathode 2 and the electron emitting element 7 to the tip of the electron emitting element 7 is sufficiently smaller than the distance between the cathode 2 and the metal back 29, effectively, the shortest distance La between the metal back 29 and the electron emitting element 7 can be considered as the distance between the metal back 29 and the surface on the metal back 29 side of the cathode 2.

FIG. 4(*a*) shows an ON state where an electric field larger than the threshold electric field Ee is applied to the electron emitting element 7 to emit electrons. Further, FIG. 4(*a*) shows a state where a higher voltage is applied to the deflection electrode 6 than to the gate 4 to deflect an electron beam orbit to irradiate the metal back 29 at a position deviated from directly above the electron emitting element 7 with an electron beam.

In this embodiment, the positive voltage is applied to the deflection electrode 6 to deflect the electron beam orbit, but it is also recommended that a negative voltage be applied to the deflection electrode 6 to deflect the electron beam orbit.

Figure 5:
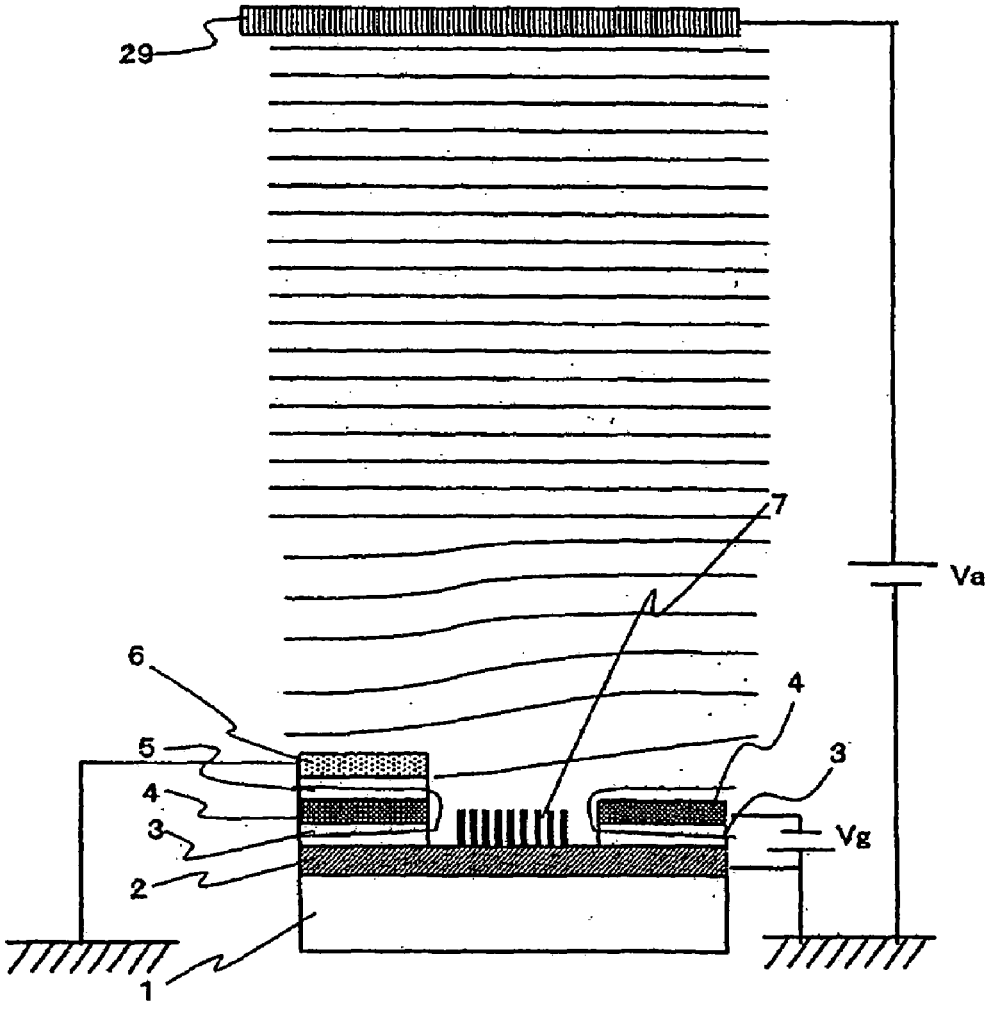
FIG. 5 is a schematic view to show the OFF state of the electron emitting device in accordance with the first embodiment of the present invention.

On the other hand, FIG. 5 shows an OFF state where a negative voltage Vg is applied to the gate 4 to form a state of (Ea+Eg<Ee) to stop electron emission from the electron emitting device.

Figure 6:
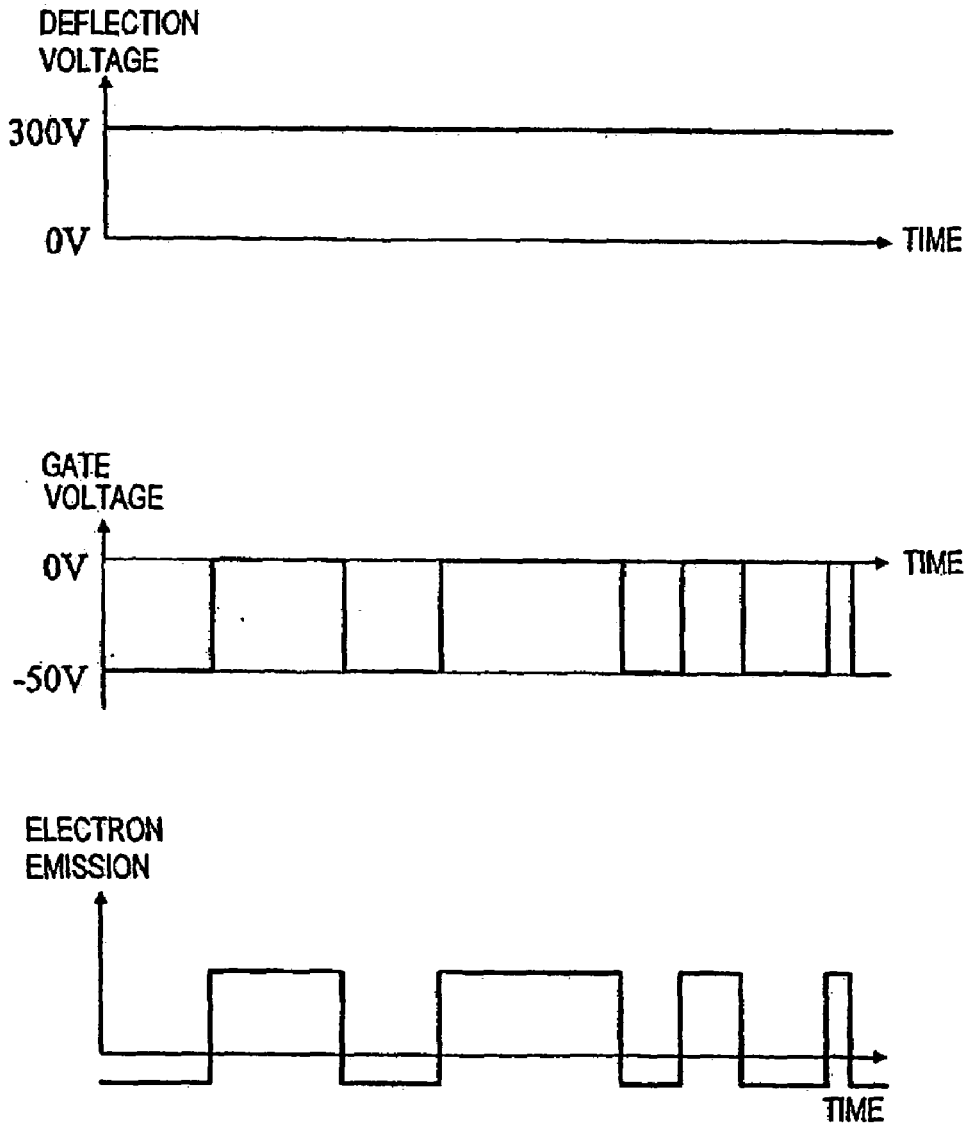
FIG. 6 is a graph to show response to the drive voltage of the electron emitting device in accordance with the first embodiment of the present invention.

That is, in the case of this embodiment, as shown in FIG. 6, the negative voltage is applied to the gate 4 to stop the electron emission and the application of the voltage to the gate 4 is stopped or a small positive voltage is applied to the gate 4 to cause the electron emission. Of course, the electron emission can be caused also by a pulse width modulation or a voltage modulation.

A positive voltage may be always applied to the deflection electrode 6, but to stop the electron emission from the electron emitting element 7 more easily, it is preferable that a voltage is not applied or a negative voltage is applied to the deflection electrode 6 in the OFF state.

Figure 7:
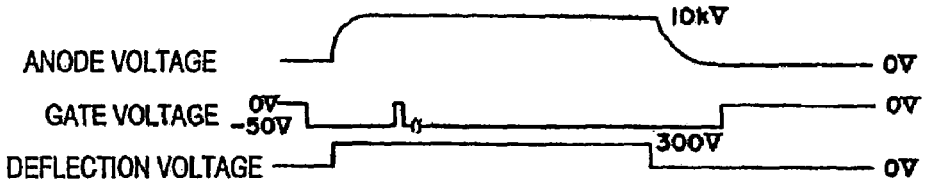
FIG. 7 is a timing chart of the drive voltage in the electron emitting device in accordance with the first embodiment of the present invention.

Next, one example of a method for driving the image forming apparatus of this embodiment, to which the above described method for driving the electron emitting device is applied, will be described with reference to FIG. 7.

First, before an electric potential of 10 kV is applied to the metal back 29, the electric potential of the gate 4 is changed from 0 V to −50 V. At the same time when an electric potential of 10 kV is applied to the metal back 29, the electric potential of the deflection electrode 6 is changed from 0 V to 300 V. Here, when the electric potential of 10 kV is applied to the metal back 29, the electric potential of the gate 4 is −50 V, so that electrons are not emitted from the electron emitting element 7. In other words, at this time, a state of (Ea+Eg+Eh<Ee) is brought about.

Thereafter, when the electric potential of the gate 4 is changed (that is, when Ea+Eg+Eh>Ee), since an electric potential of 300 V is already applied to the deflection electrode 6, electrons emitted from the electron emitting element 7 do not collide with the metal back 29 directly above the electron emitting element 7.

In this regard, the electric potential of the metal back 29 returns to 0 V and then the electric potential of the gate 4 is returned to 0 V. With this, when the application of the voltage to the metal back 29 is started or stopped such as when the power is turned on or off, it is possible to prevent the electrons, emitted by the electric field formed by the electric potential of the metal back 29, from causing the display to emit light abnormally.

Further, since the electron beam orbit is deflected by the voltage applied to the deflection electrode 6, the electron beam does not collide with the metal back 29 directly above the electron emitting element 7. With this, generated ions hardly fall onto the electron emitting element 7, which can reduce the deterioration of characteristics of the electric emission device.

In this regard, the method for driving the image forming apparatus in this embodiment is not limited to the above described method for controlling the electric potential of the gate 4. When the application of a voltage of 10 kV to the metal back 29 is started, irrespective of the electric potential of the gate 4, an electric potential of 300 V is applied to the deflection electrode 6 before the electric potential of the metal back 29 is brought to an electric potential of causing electron emission. Further, in the case of stopping power supply, the electric potential of the deflection electrode 6 is kept until the electric potential of the metal back 29 is reduced to a level lower than an electric potential where electron emission is not caused and then the electric potential of the deflection electrode 6 is controlled to 0 V. With this, even if a potential difference causing electron emission is generated between the cathode and the metal back, the irradiation of the electron emitting element 7 with ions can be prevented.

Further, as a method of preventing the abnormal light emission of the display especially when the power is turned on and/or off, there is also the following method: irrespective of the electric potential of the gate 4, the electric potential of the deflection electrode 6 is changed to a negative electric potential (for example, −200 V) before a electric potential of 10 kV is applied to the metal back 29 and then after the electric potential of 10 kV is applied to the metal back 29, the electric potential of the deflection electrode 6 is changed to 300 V.

Still further, in the case of stopping power supply, irrespective of the electric potential of the gate 4, the electric potential of the deflection electrode 6 is changed from 300 V to −200 V and is kept at −200 V until the electric potential of the metal back 29 is reduced to a level lower that an electric potential where electron emission is not caused and then the electric potential of the deflection electrode 6 is control led 0 V. With this, even if an electric potential difference causing electron emission is generated between the cathode and the metal back, the irradiation of the electron emitting element 7 with ions and the abnormal light emission of the display can be prevented.

In other words, also by applying an electric potential for deflecting electrons emitted from the electron emitting element 7 to the deflection electrode 6 as electron emission preventing means or by controlling the application of the electric potential for preventing the electron emission from the electron emitting element 7, the deterioration of the electron emitting element 7 and the abnormal light emission of the display can be prevented.

The control of the power sources as described above can be achieved by controlling the respective power sources in association with each other by means of a control circuit 1303 operatively connected to a main power switch and the power switch of a remote controller, which will be described later.

Here, the voltage values in the above description of the drive method have been described only by way of examples.

Figure 8A:
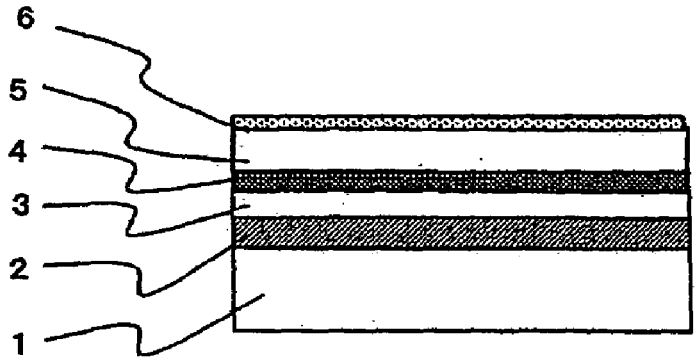
FIG. 8 is a schematic view to show a manufacturing process of the electron emitting device in accordance with the first embodiment of, the present invention.
Figure 8B:
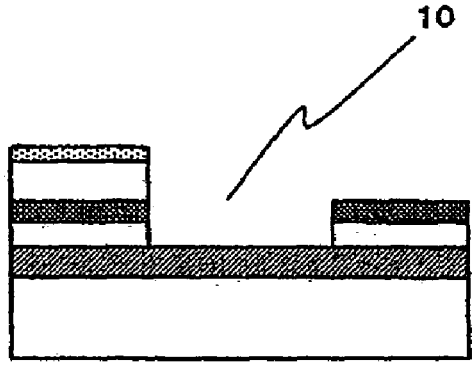
Figure 8C:
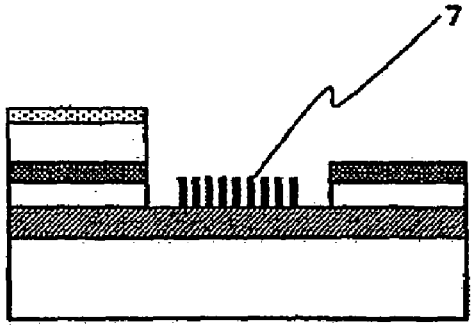

Next, one example of a method for manufacturing the electron emitting device in accordance with this embodiment, shown in FIG. 4(*a*) and FIG. 4(*b*), will be described with reference to FIG. 8.

A cathode 2 is formed over a board 1 the surface of which is sufficiently cleaned in advance and which is: a board made of quartz glass or glass having an impurity content such as Na reduced; a board made of a stacked body made of stacking $SiO_2$ over a soda-lime glass, a silicon substrate, or the like by sputtering method; or an insulating board made of ceramics such as alumina.

The cathode 2 is generally conductive and is formed by means of a common vacuum film forming technology such as a vapor deposition method and a sputtering method and a photolithography technology.

Materials used for the cathode 2 include: metal such as Be, Mg, Ti, Zr, Hf, V, Nb, Ta, Mo, W, Al, Cu, Ni, Cr, Au, Pt, and Pd or metal alloy thereof; carbide such as TiC, Zrc, HfC, TaC, SiC, and WC; boride such as HfB2, ZrB2, LaB6, CeB6, YB4, and GdB4; nitride such as TiN, ZrN, and HfN; and semiconductor such as Si and Ge.

Further, the thickness of the cathode 2 can range from 10 nm to 100 μm and more preferably, from 100 nm to 10 μm.

A first insulating layer 3 is deposited following the cathode 2. The first insulating layer 3 is formed by means of a common vacuum film forming method such as sputtering method, thermal oxidation method, and anodic oxidation method. Materials used for the first insulating layer 3 include SiO2, SiN, Al2O3, and CaF. The thickness of the first insulating layer 3 can range from 10 nm to 10 μm.

Further, a gate 4 is deposited over the first insulating layer 3.

The gate 4 is also conductive like the cathode 2 and is formed by means of a common vacuum film forming technology such as the vapor deposition method, the sputtering method, and the photolithography technology.

Materials used for the gate 4 include: metal such as Be, Mg, Ti, Zr, Hf, V, Nb, Ta, Mo, W, Al, Cu, Ni, Cr, Au, Pt, and Pd or metal alloy thereof; carbide such as TiC, Zrc, HfC, TaC, Sic, and WC; boride such as HfB2, ZrB2, LaB6, CeB6, YB4, and GdB4; nitride such as TiN, ZrN, and HfN; semiconductor such as Si and Ge; and carbon.

The gate 4 is preferably made of material having a larger work function as compared with the cathode 2 so that electrons are not emitted by the electric field of the metal back 29.

The thickness of the gate 4 can range from 10 nm to 1 μm.

Further, a second insulating layer 5 is deposited over the gate 4. The second insulating layer 5 can be formed by the same method and of the same material as the first insulating layer 3. The thickness of the second insulating layer 5 can range from 10 nm to 10 μm.

Still further, a deflection electrode 6 is deposited over the second insulating layer 5 (FIG. 8(*a*)). The deflection electrode 6 can be formed by the same method and of the same material as the gate 4. The thickness of the deflection electrode 6 can range from 10 nm to 1 μm.

Next, by the photolithography technology, portions of the deflection electrode 6, the second insulating layer 5, the gate 4, and the first insulating layer 3 are removed from the board 1, to form an opening 10 so that the cathode 2 is exposed to the metal back 29 side (FIG. 8(*b*)).

This opening 10 is formed in such a way that the stacked region of the first insulating layer 3 and the gate 4 is arranged around the opening 10. Further, this etching process may be stopped above the cathode 2 or after a portion of the cathode 2 is etched off.

The opening 10 formed in this etching process can be formed in the shape of not only a rectangle but also, for example, a hole and a slit. Further, the size of the opening 10 can be selected from the most suitable region according to a necessary beam size, a drive voltage and the like and can range from 10 nm to 100 μm.

The deflection electrode 6 is patterned in the shape of a stripe by means of the photolithography technology in such a way as to face a portion of side of the opening 10.

Then, an electron emitting element 7 is formed on the cathode 2 in the opening 10 (FIG. 8(*c*)). The electron emitting element 7 can be used carbon base material such as fullerene, diamond, diamond-like carbon (DLC), and carbon fiber.

A method for forming the electron emitting element 7 includes a method for applying a coating of previously formed carbon base material to the surface of a cathode by a spray method or the like, a vacuum vapor deposition method such as a sputtering method, and a method of growing the electron emitting element in gas including carbon by using material to be a catalyst as a cathode or by forming a catalytic material over the cathode.

The electron emitting element 7, as described above, can, be used carbon base materials such as fullerene, diamond, diamond-like carbon (DLC), and carbon fiber.

Hereafter, a carbon fiber in accordance with the invention will be described.

In the invention, "a carbon fiber" is a fiber containing carbon and preferably is a fiber whose main component is carbon. Further, the diameter of the carbon fiber 6 preferably ranges from 0.1 nm to 1 μm, more preferably from 1 nm to 500 nm, still more preferably from 5 nm to 100 nm for the purpose of realizing a stable emission current Ie. Further, the length of the carbon fiber is preferably 10 times or more the diameter. The length of the carbon fiber is more preferably 50 times or more the diameter to produce an effect of increasing an electric field intensity to be applied and still more preferably 100 times of more the diameter.

Here, graphite is formed of carbon planes, each of which is formed of regular hexagons formed by carbon atoms covalently bonded by $sp^2$ hybridization and arranged closely without a clearance, stacked with a distance of about 3.354 Å, ideally, between them. A piece of carbon plane is called "graphene" or "graphene sheet".

Graphene formed in the shape of a cylinder is called "carbon nano tube". A carbon nano tube in which a cylindrical graphene has a multiple structure is called "a multi-wall carbon nano tube". On the other hand, a carbon nano tube constructed of one cylindrical graphen is called "a single-wall carbon nano tube". In particular, in these carbon nano tubes, the threshold electric field necessary for electron emission is most lowered when the graphene at the tip of the tube is not closed but opened. Further, there are also graphenes having a structure like the joint of bamboo in the hollow structure of the multi-wall carbon nano tube. In the most of them, the angle of the graphene at the outermost periphery with respect to the axis of the fiber is nearly equal to 0° and this structure is also included in the carbon nano tube. These carbon nano tubes are characterized in that the axial direction of the fiber is nearly parallel to the surface of the graphene formed on the outermost periphery formed in a cylindrical shape (an angle formed by the axis of the fiber (direction of length of the fiber) and the graphene is nearly equal to 0°) and that the tube is absolutely hollow.

On the other hand, a carbon fiber constructed of a plurality of graphenes stacked in the axial direction is called "a graphite nano fiber" and is discriminated from the above-described carbon nano tube. In other words, in the above-described carbon nano tube, a c axis (direction in which a plurality of graphenes are stacked or a direction perpendicular to the surface of the graphene) is substantially perpendicular to the axial direction of the fiber (direction of length of the fiber) whereas in the graphite nano fiber, the c axis (direction in which a plurality of graphenes are stacked or a direction perpendicular to the surface of the graphene) is not perpendicular to the axial direction of the fiber (direction of length of the fiber) (typically, parallel to the axial direction of the fiber).

A type in which an angle formed by the axis of the fiber and the surface of the graphene is nearly equal to 90° is called "a platelet type". In other words, this carbon fiber has a structure in which many graphenes are stacked like trump cards. On the other hand, a type in which the angle of the surface of the graphene with respect to the axial direction of the fiber is smaller than 90° and larger than 0° is called "a herring bone type". This "herring-bone type" includes a type in which graphenes having a hole and shaped like a cup are stacked. Further, a type in which graphenes shaped like opened book are stacked (a type in which graphenes shaped like a letter V ate stacked) is also included in the "herring-bone type".

The central portion of the fiber axis of the herring-bone type is hollow in some case and is filled with amorphous carbon (in an electron beam diffraction image of a TEM, the bright and dark image of a lattice can not be seen, but only a broad ring pattern can be seen) in other case.

In FIG. 22 is shown an example of excellently straight carbon fibers, but not-straight and bent carbon fibers can be also used.

Either of the carbon fibers has a threshold of electron emission ranging from about 1 V/μm to 10 V/μm and has desirable characteristics as an electron emitting material. In the case of forming an electron emitting device by using a carbon fiber as an electron emitting element, one, electron emitting device includes a plurality of carbon fibers.

It is more preferable to use a graphite nano fiber as the electron emitting element. This is because an electron emission current density of an electron emitting device using a plurality of graphite nano fibers is larger than one of an electron emitting device using carbon nano tube.

It is thought that the graphite nano fiber, in contrast to a carbon nano tube, has fine dips and bumps on its surface (on the side of the fiber) and hence easily causes electric field concentration and hence easily emits electrons. Further, it is thought that since the graphene extends toward the outer periphery (surface) of, the fiber from the center axis of the fiber, the graphene easily emits electrons.

FIG. 21 and FIG. 22 schematically show a carbon fiber formed on the cathode 2. FIG. 21 is a schematic view to show a state where a plurality of carbon nano tubes are formed as the electron emitting element 7 on the cathode 2 and FIG. 22 is a schematic view to show a state where a plurality of graphite nano fibers are formed as the electron emitting element 7 on the cathode 2.

Figure 21A:
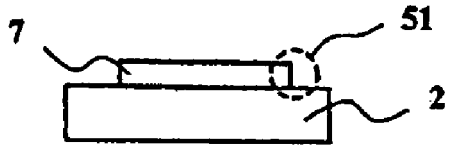
FIG. 21(*a*) is a schematic view to show a bonding portion of a cathode and an electron emitting element in an image forming apparatus of the invention and FIG. 21(*b*) is a schematic enlarged view of the bonding portion of the cathode and the electron emitting element in FIG. 21(*a*) and FIG. 21(*c*) is a schematic enlarged view of the vicinity of the tips of carbon fibers constructing the electron emitting element in FIG. 21(*b*)
Figure 21B:
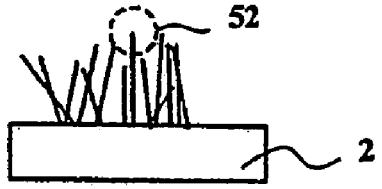
Figure 21C:
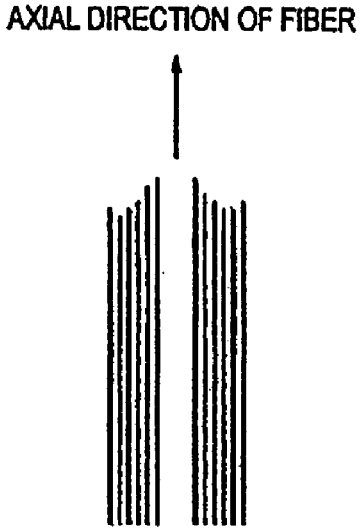

FIG. 21(*a*) and FIG. 22(*a*) are forms observed by an optical microscope (under a magnification up to 1,000 times) and are schematic views to show the film like electron emitting element 7 and the cathode 2. FIG. 21(*b*) and FIG. 22(*b*) are forms observed by a scanning electron microscope (SEM) (under a magnification up to 30,000 times). FIG. 21(*b*) is an enlarged view of a portion 51 in FIG. 21(*a*). Similarly, FIG. 22(*b*) is an enlarged view of a portion 61 in FIG. 22(*a*). FIG. 21(*b*) and FIG. 22(*b*) show a state where the electron emitting element 7 observed as the form of a film in FIG. 21(*a*) and FIG. 22(*a*) is constructed of a plurality of carbon fibers. FIG. 21(*c*), FIG. 22(*c*) and FIG. 22(*d*) are forms observed by a transmission electron microscope (TEM) (under a magnification up to 1,000,000 times). FIG. 21C is an enlarged view of a portion 52 in FIG. 21(*b*) Similarly, FIG. 22(*c*) and FIG. 22(*d*) are enlarged views of different portions 62 and 63 in FIG. 22B. FIG. 21C shows a state where cylindrical graphenes have a multiple structure, that is, a carbon fiber is a multi-wall carbon nano tube. FIG. 22C and FIG. 22D show a state where graphenes are stacked non-parallel to the axis of the fiber, that is, a carbon fiber is a graphite nano fiber.

Figure 3:
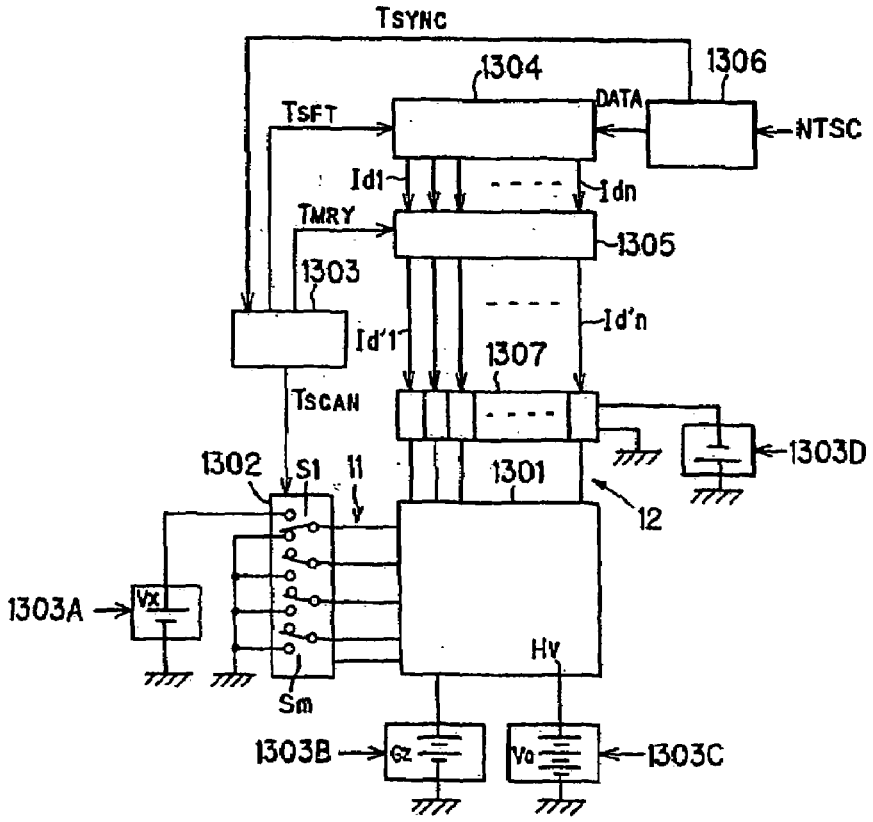
FIG. 3 is a block diagram to describe an arrangement for driving of an image forming apparatus in accordance with the first embodiment of the present invention.

Next, an arrangement for driving of the image forming apparatus including the above-described display panel 1301 and a drive circuit will be described with reference to a block diagram shown in FIG. 3.

First, referring to a scanning circuit 1302, the scanning circuit 1302 has m switching devices (in the drawing, schematically shown by S1 to Sm). Each switching device is adapted to select the output voltage Vx of a DC voltage source 1303A or 0 V (ground level) and is electrically connected to each of the terminals of the display panel 1301 (these terminals acre terminals connected to the wirings C1 to Cm in the X direction described in FIG. 1).

The respective switching devices S1 to Sm operate on the basis of a control signal TSCAN outputted from a control circuit 1303 and can be constructed of a combination of switching devices such as FET.

In this embodiment, the DC voltage Vx is set on the basis of the characteristics (electron emission threshold voltage) of the electron emitting device in such a way as to output a certain voltage such that drive voltages applied to the electron emitting devices that are not scanned become smaller than an electron emission threshold voltage.

The deflection electrode 6 is connected to a voltage source 1303B to apply a DC voltage Gz.

The control circuit 1303 has a function of matching the operations of the respective parts in such a way that an image can be suitably displayed on the basis of an image signal inputted from the outside. The control circuit 1303 generates control signals of TSCAN, TSFT, and TMRY for the respective parts on the basis of a synchronization signal TSYNC sent from a synchronization signal separation circuit 1306. Further the control circuit 1303 turns on or off each of the power sources from 1303A to 1303D.

The synchronization signal separation circuit 1306 is a circuit to separate a NTSC-mode television signal inputted from the outside into a synchronization signal component and a brightness signal component and can be constructed of a common frequency separation (filter) circuit or the like. The synchronization signal separated by the synchronization separation circuit 1306 includes a vertical synchronization signal and a horizontal, synchronization signal and is shown here as a TSYNC signal for the sake of convenience of description.

The brightness signal component of the image separated from the television signal is denoted by a DATA signal for the sake of convenience. The DATA signal is inputted to a shift register 1304.

The shift register 1304 is used for a serial/parallel conversion of the DATA signal inputted serially in time sequence for each line of an image and is operated on the basis of the control signal TSFT sent from the control circuit 1303 (that is, it can be also said that the control signal TSFT is a shift clock of the shift register 1304).

The data of one line of the image subjected to the serial/parallel conversion (corresponding to the drive data of n electron emitting devices) is outputted as n parallel signals from Id1 to Idn from the shift register 1304.

A line memory 1305 is a storage device to store the data of one line of the image for a necessary time and appropriately stores the contents of the image data from Id1 to Idn according to the control signal TMRY sent from the control circuit 1303. The stored contents are outputted as image data from I'd1 to I'dn and are inputted to a modulation signal generator 1307.

The modulation signal generator 1307 is a signal source to suitably modulate the respective electron emitting devices in accordance with this embodiment according to the respective image data from I'd1 to I'dn and its output signal is applied to the electron emitting devices in accordance with this embodiment in the display panel 1301 through terminals from Doy1 to Doyn.

Here, the electron emitting device in accordance with this embodiment has the following current-voltage characteristics.

The electron emitting device in accordance with this embodiment has a characteristic that an emission current in creases non-linearly with an increasing gate voltage, that is, as the gate voltage increases, the emission current increases rapidly. A gate voltage when the emission current starts increasing rapidly is called an electron emission threshold voltage.

Hence, in a case where a pulse-like voltage is applied to the electron emitting device, for example, even when a voltage smaller than the electron emission threshold voltage is applied, electrons are hardly emitted but when a voltage larger than the electron emission threshold voltage is applied, many electrons are emitted. At this time, the intensity of an output electron beam can be controlled by changing the voltage peak value Vm of the pulse.

Further, the total quantity of electric charges of the electron beam outputted from the electron emitting element 7 can be controlled by changing a pulse width Pw.

Hence, a voltage modulation mode, a pulse width modulation mode, or a mode of a combination of them, that is, a mode of suitably modulating both of a voltage peak value and a pulse width can be adopted as a mode of modulating an electron emitting device according to an input signal. When a voltage modulation mode is used, a voltage modulation circuit that generates a voltage pulse of a predetermined length and suitably modulates the peak value of a pulse according to input data can be used as a modulation signal generator 1307.

When a pulse width modulation mode is used, a pulse width modulation circuit that generates a voltage pulse of a predetermined peak value and suitably modulates the width of a voltage pulse according to input data can be used as a modulation signal generator 1307.

The shift register and the line memory can be used a shift register and a line memory of a digital signal mode or an analog signal mode. This is because it is only essential that the serial/parallel conversion or the storage of the image signal can be performed at a predetermined speed.

In the case of using the digital signal mode, the output signal. DATA of the synchronization signal separation circuit 1306 needs to be converted into a digital signal and for this purpose, it is recommended to provide an A/D converter in the output section of the synchronization signal separation circuit 1306. In relation to this, depending on whether the output signal of the line memory 1305 is a digital signal or an analog signal, a circuit used for the modulation signal generator 1307 is a little different.

That is, in the case of a voltage modulation mode using a digital signal, for example, an A/D conversion circuit is used for the modulation signal generator 1307 and an amplification circuit is further added thereto, if necessary In the case of a pulse width modulation mode, for example, a combination of a high-speed oscillator, a counter for counting the number of waves outputted by the oscillator, and a comparator for comparing the output value of the counter with the output value of the memory is used. If necessary, an amplifier for amplifying the voltage of a modulation signal, which is outputted by the comparator and is pulse width modulated, to the drive voltage of the electron emitting device of the invention can be also added thereto. In the case of the voltage modulation mode using an analog signal, an amplification circuit using, for example, an operational amplifier can be adopted and a level shift circuit can be added thereto, if necessary. In the case of the pulse width modulation mode, for example, a voltage control type oscillation circuit (VCO) can be adopted and if necessary, an amplifier for amplifying a voltage to the drive voltage of the electron emitting device of the invention can be also added thereto.

The construction of the image forming apparatus described above is one example of an image forming apparatus to which the invention can be applied and various modifications can be made on the basis of the technical ideas of the invention. For example, as for the input signal, the NTSC mode has been described above. However, it is not intended to limit the input signal to this but a PAL mode, a SECAM mode and a digital broadcast mode, and a TV signal mode including more scanning lines than them (for example, high-definition TV including a MUSE mode) can be also adopted.

Hereafter, an image reception display apparatus using the image forming apparatus in accordance with this embodiment will be described with reference to FIG. 23.

Figure 23:
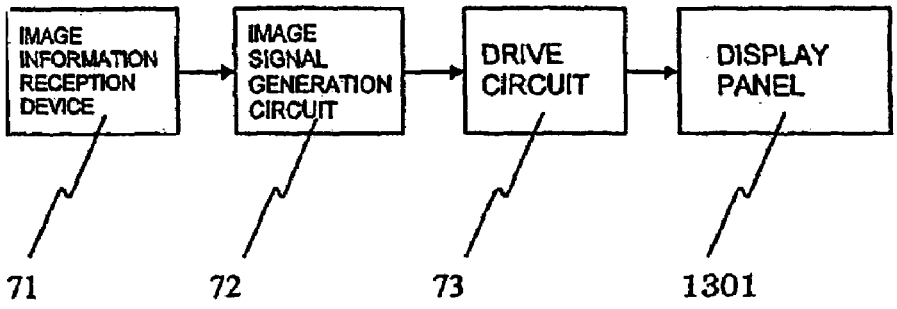
FIG. 23 shows the construction of an image reception display apparatus in accordance with the first embodiment of the invention.

FIG. 23 shows the general construction of an image reception display apparatus using the image forming apparatus of the invention. In FIG. 23, a reference 71 denotes an image information reception device, 72 denotes an image signal generation circuit, 73 denotes a drive circuit, and 1301 denotes a display panel of the invention. First, image information received by the image information reception device 71 is inputted to the image signal generation circuit 72 to generate an image signal. The image information reception device 71 can be used a receiver such as a tuner capable of selecting and receiving a wireless broadcast, a broadcast via a cable, or an image broadcast through the Internet. Further, if an audio unit is connected to the image information reception device 71, a television set can be constructed of the image information reception device 71 with audio unit, the image signal generation circuit 72, the drive circuit 73, and the display panel 1301. The image signal generation circuit 72 generates an image signal corresponding to each of the pixels of the display panel 1301 from the image information and inputs the image signal to the drive circuit 73. The drive circuit 73 controls a voltage to be applied to the display panel 1301 on the basis of the inputted image signal, thereby making the display panel 1301 display an image.

In this regard, in the image reception display device like this, a display panel to be later described in the second embodiment to the fifth embodiment can be replaced by the above-described display panel 1301.

In this embodiment, by arranging the deflection electrode 6 on the gate 4 via the second insulating layer 5 and by deflecting the orbit of electrons emitted from the electron emitting element 7, it is possible to prevent the electron beam from colliding with the metal back 29 directly above the electron emitting element 7. With this, it is possible to prevent generated ions from falling onto the electron emitting element 7 and as a result, to reduce the deterioration of characteristics of the electron emitting device.

Further, according to the method of driving the image forming apparatus in accordance with this embodiment, it is possible to prevent the display from emitting light abnormally when power is turned on or off.

(Second Embodiment)

A display panel in accordance with the second embodiment will be described with reference to FIG. 2.

A display panel in accordance with the second embodiment is the same as the display panel 1301 in accordance with the first embodiment except that a conductive plate 15 is interposed between the electron emitting element 7 and the back metal 29. The same constituent members are denoted by the same reference numerals. Hereafter, parts different from those in the first embodiment will be described.

Figure 2:
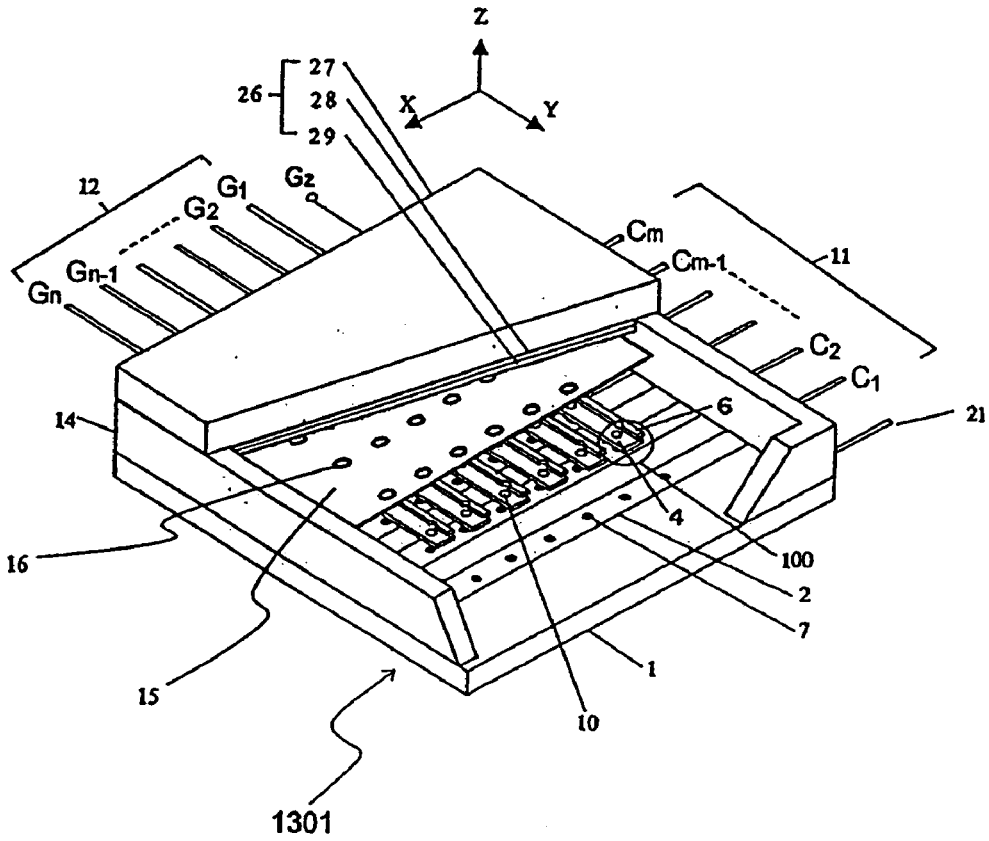
FIG. 2 is a perspective view of a display panel in accordance with the second embodiment of the present invention.

As shown in FIG. 2, a conductive plate 15 is interposed as an electron beam intercepting element (electron intercepting member) between the board 1 and the metal back 29. Further, the conductive plate 15 has through holes 16 through which electrons pass at positions except directly above the electron emitting element 7. Further, assuming that the electric potential of the conductive plate 15 is Vs and that the distance between the board 1 and the conductive plate 15 is a and that the distance between the metal back 29 and the conductive plate 15 is b, Vs is kept at a value of $Vs \cong a/(a+b) \times Va$, not to disturb an electric field formed between the board 1 and the metal back 29.

A method for controlling electron emission from the respective electron emitting devices 100 in the image forming apparatus in accordance with this embodiment will be described with reference to FIG. 24 and FIG. 25.

Figure 24:
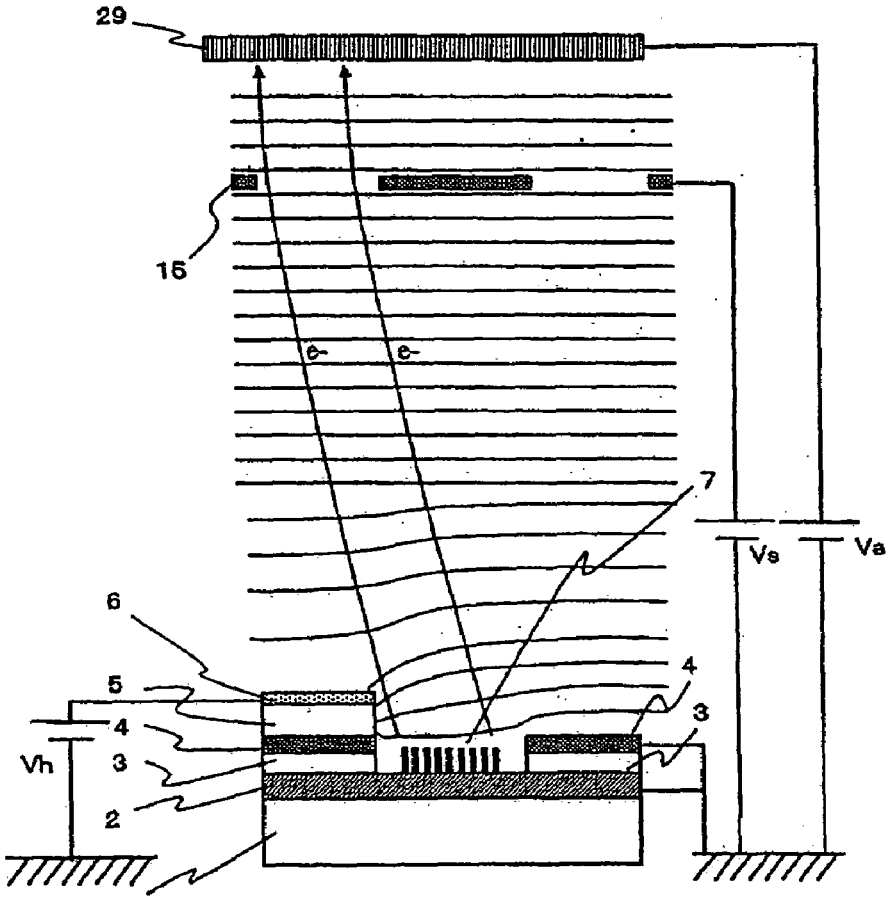
FIG. 24 is a schematic view to show an ON state in an electron emitting device in accordance with the second embodiment of the invention.
Figure 25:
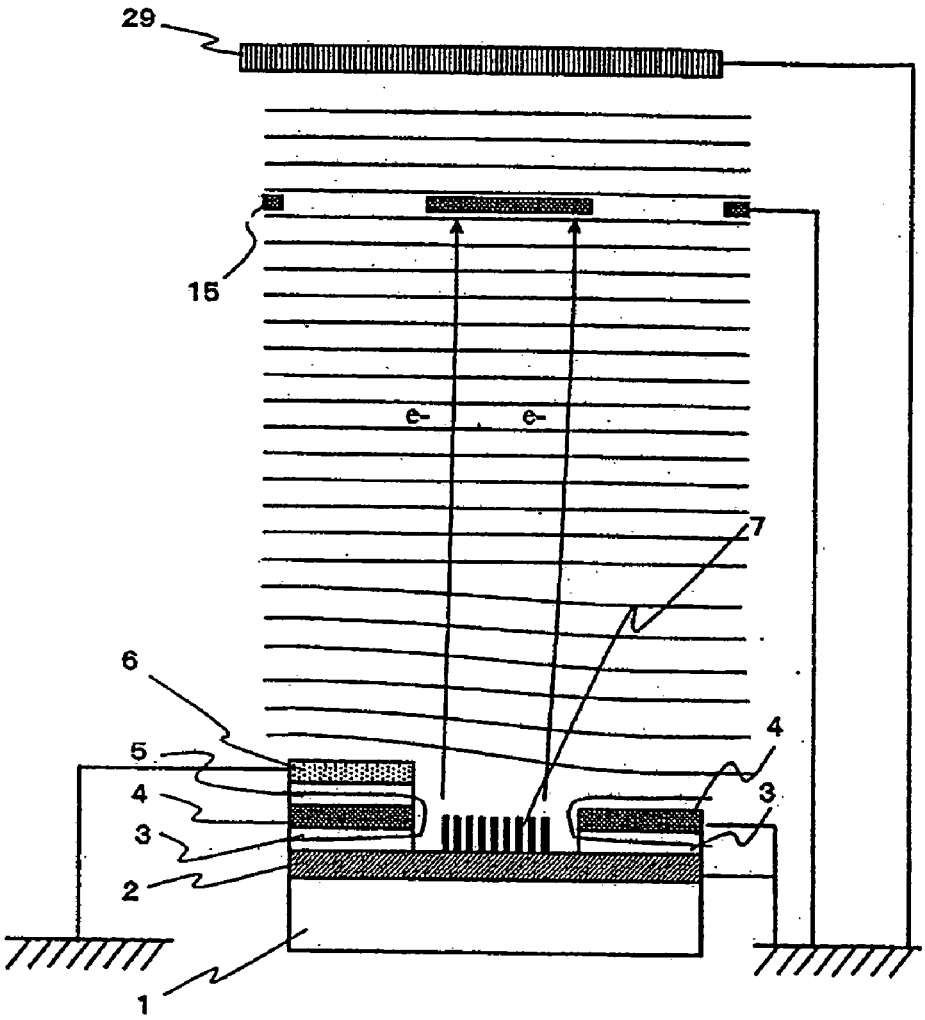
FIG. 25 is a schematic view to show a state immediately after power being turned off in the electron emitting device in accordance with the second embodiment of the invention.

FIG. 24 shows an electric potential distribution and an electron beam orbit in the ON state of one electron emitting device. FIG. 25 shows an electric potential distribution and an electron beam orbit in a state immediately after the power of the image forming apparatus being turned off.

In the ON state shown in FIG. 24, a voltage Va between the metal back and cathode is applied to apply an electric field larger than the threshold electric field Ee to the electron emitting element 7, whereby electrons are emitted. The emitted electrons are affected and deflected by the electric field caused by such a voltage Vh between the deflection electrode and the cathode that is applied to the deflection electrode 6. Further, the electrons emitted from the electron emitting element 7 pass through the through holes 16 made in the conductive plate 7 interposed between the metal back 29 and the electron emitting element 7 and reach the metal back 29. Since the through holes 16 are formed at positions deviated from directly above the electron emitting elements 7, in a case where a deflection electric potential is applied to the deflection electrode 6, the emitted electrons can reach the metal back 29.

Immediately after the power is turned off, the electric potentials of the deflection electrode 6 and the gate 4 are brought to 0 V and electric charges charged at high voltage are in the metal back 29, so that the electric potential of the metal back 29 does not drop immediately and hence electrons are emitted in some cases. In this case, in the image forming apparatus of this embodiment, as shown in FIG. 25, the electron beam orbit goes directly above the electron emitting element 7, so that the electrons collide with the conductive plate 15, which can prevent the light emission of the display when the power is turned off.

In this embodiment, the conductive plate 15 is arranged directly above the electron emitting element 7 to intercept the electrons emitted directly above the electron emitting element 7, so that it is possible to prevent the display from emitting light abnormally when the power is turned on and/or off. Further, as is the case with the first embodiment, the electron beam orbit is deflected to prevent the electrons from colliding with the metal back 29 directly above the electron emitting element 7. With this, it is possible to prevent generated ions from falling onto the electron emitting element 7 and hence to reduce the deterioration of the characteristics of the electron emitting device.

(Third Embodiment)

Figure 9:
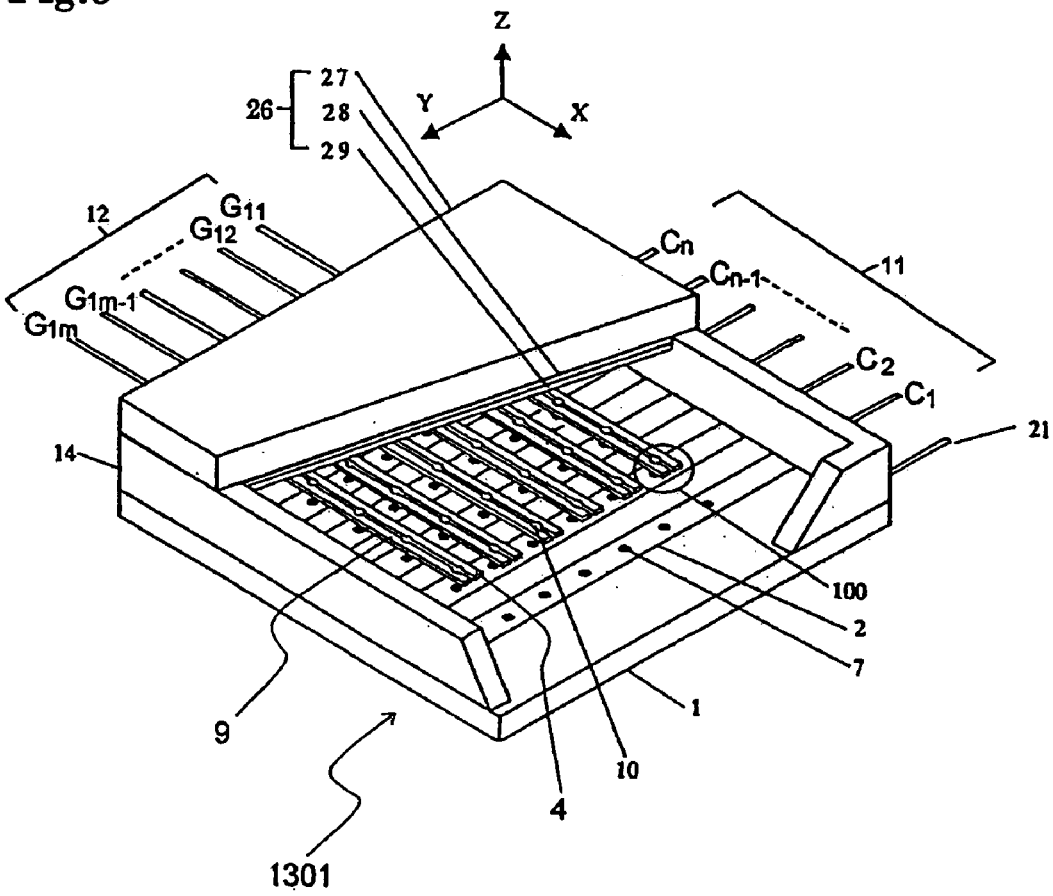
FIG. 9 is a perspective view of a display panel in accordance with the third embodiment of the present invention.

A display panel 1301 in accordance with the third embodiment of the invention will be described with reference to FIG. 9.

In this embodiment, the first gate 4 and the second gate 9 each having a function of wiring are arranged parallel to the X direction on the cathode 2. That is, the gate in the first embodiment is divided into two parts in the X direction (X-Y direction is in an inverse relationship between the first embodiment and the third embodiment). In FIG. 9, wirings 12 in the X direction include 2×m wirings of m wirings G11, G12, . . . , G1*m* and *m* wirings (not shown) G21, G22, . . . , G2*m* which are pulled toward the front side. Here, the m wirings G11, G12, . . . , G1*m* also serve as the first gate 4 and are formed in the shape of a stripe. Further, the m wirings G21, G22, . . . , G2*m* also serve as the second gate 9 and are formed in the shape of a stripe.

A method for controlling electron emission from the respective electron emitting devices 100 in the image forming apparatus in accordance with this embodiment will be described with reference to FIG. 10, FIG. 12 and FIG. 13.

FIG. 10(*a*) shows a sectional view of one electron emitting device 100 in the image forming apparatus in accordance with this embodiment. Further, FIG. 10(*b*) shows a plan view of the electron emitting device 100. In the drawing, a reference numeral 4 denotes the first gate and 9 denotes the second gate.

FIG. 10(*a*) shows an electric potential distribution and an electron beam orbit in the ON state of the electron emitting device. FIG. 12 shows an electric potential distribution in the OFF state. Further, FIG. 13 shows timings of applying voltage to the first gate 4, the second gate 9, and the cathode 2 of the electron emitting device and the response of electron emission to the applied voltage.

Here, assuming that a threshold electric field required to emit electrons from the electron emitting element 7 is Ee, that an electric field applied to the electron emitting element by applying voltage to the metal back 29 is Ea, that an electric field applied to the electron emitting element by applying voltage to the first gate 4 is Eg1 and that an electric field applied to the electron emitting element by applying voltage to the second gate 9 is Eg2, in the case of a drive state in which electrons are emitted, voltages are applied to the cathode 2, the metal back 29, the first gate 4, and the second gate 9 in such a way that (Ea+Eg2>Ee and Ea>Eg2) or (Ea+Eg1+Eg2>Ee and Ea>Eg1+Eg2) is satisfied.

The second gate 9, as is the case with the deflection electrode 6 in the first embodiment, has not only a function of deflecting the electron beam orbit but also a function of controlling the electron emission.

FIG. 10(*a*) shows a state where an electric field larger than the threshold electric field Ee to start electron emission is applied to the electron emitting element 7 to emit electrons. At this time, a voltage Va between the metal back and the cathode is applied. By Eg1<Eg2, the electron beam orbit is affected and deflected by the electric field by the voltage Vg2 between the second gate and cathode, which is applied to the second gate 9, whereby electrons collide with the metal back 29 at a position deviated from directly above the electron emitting element 7.

Figure 12:
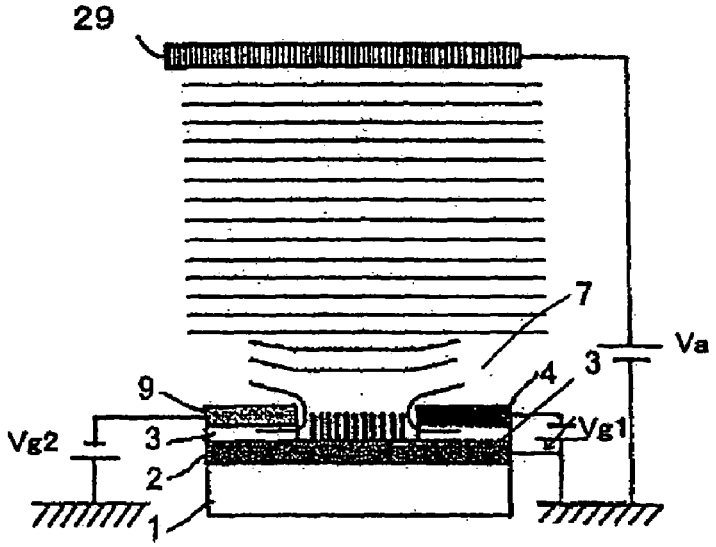
FIG. 12 is a schematic view to show the OFF state of the electron emitting device in accordance with the third embodiment of the present invention.
Figure 13A:
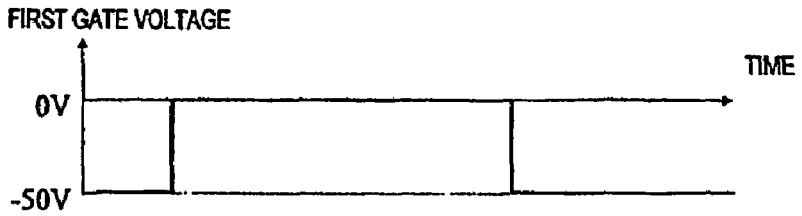
FIG. 13 is a graph to show response to the drive voltage of the electron emitting device in accordance with the third embodiment of the present invention.
Figure 13B:
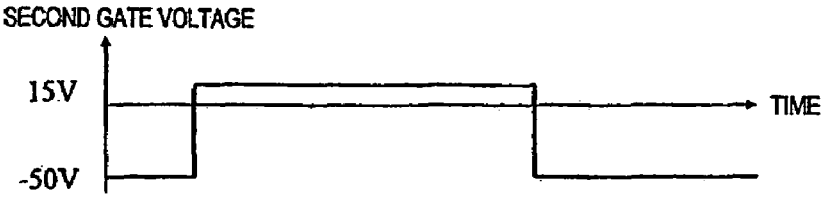
Figure 13C:
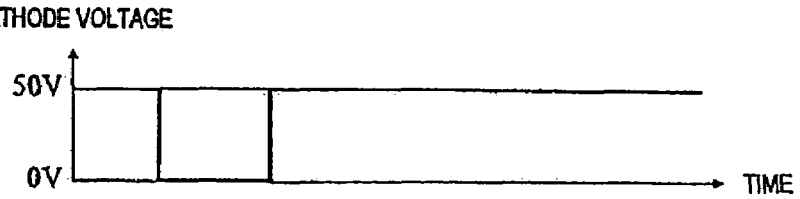
Figure 13D:
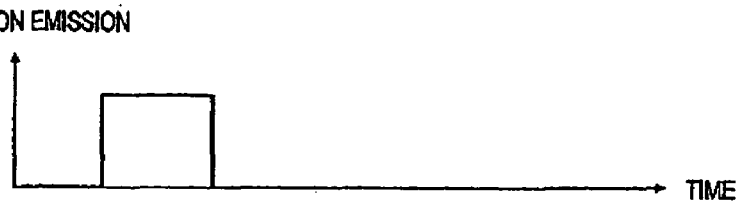

On the other hand, in a state shown in FIG. 12, negative voltages Vg1 and Vg2 are applied to the first gate 4 and the second gate 9, respectively, whereby a state of Ee+Eg1+Eg2<Ee is brought about and the electron emitting device is brought to the OFF state.

That is, in the case of this embodiment, like a response to drive voltages shown in FIG. 13, electron emission is stopped in a state where the negative voltage (−50 V) is applied to the first gate 4 and the second gate 9. Further, in a state where the application of voltage to the first gate 4 is stopped (0 V) and where a small positive voltage (deflection voltage: 15 V) is applied to the second gate 9, even if the cathode 2 is at a positive voltage (50 V); electrons are not emitted. In this state, if the application of voltage to the cathode 2 is stopped (0 V), electrons are emitted. In this manner, the pulse width of the electron emission can be modulated.

Figure 14:
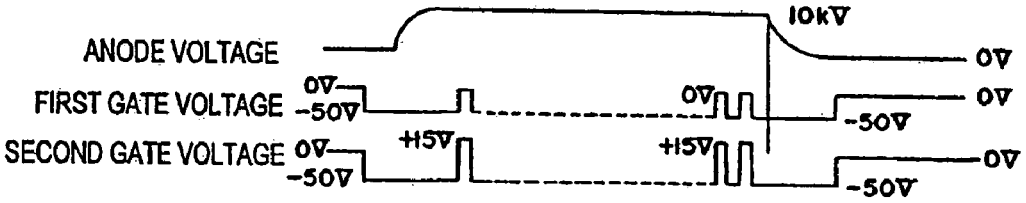
FIG. 14 is a timing chart of the drive voltage in the electron emitting device in accordance with the third embodiment of the present invention.

Next, one example of a method for driving, the image forming apparatus to which the method for driving the electron emitting device of this embodiment is applied will be described with reference to FIG. 14.

First, before an electric potential of 10 kV, is applied to the metal back 29, the electric potentials of the first gate 4 and the second gate 9 are changed from 0 V to −50 V. Here, when the electric potential of 10 kV is applied to the metal back 29, since both of the electric potentials of the first gate 4 and the second gate 9 are −50 V, the electrons of the cathode 2 are not emitted irrespective of the electric potential of the cathode 2.

Thereafter, when the electric potential of 10 kV is applied to the metal back 29 and the electric potential of the first gate 4 is changed to 0 V and the electric potential of the second gate 9 is changed to 15 V, since a voltage of 15 V is applied to the second gate 9, electrons emitted from the electron emitting element 7 do not collide with the metal back 29 directly above the electron emitting element 7.

Further, when the application of the electric potential to the metal back 29 is stopped, the electric potentials of the first gate 4 and the second gate 9 are returned to 0 V from 50V after the electric potential applied to the metal back 29 returns to 0 V. With this, it is possible to prevent the display from being made to emit light by the emitted electrons when the application of the electric potential to the metal back 29 is started or stopped such as when the power is turned on and off.

Further, different electric potentials are applied to the first gate 4 and the second gate 9 to deflect the electron beam orbit to prevent the electron beam from colliding with the metal back 29 directly above the electron emitting element 7. With this, generated ions hardly fall onto the electron emitting element 7, which can reduce the deterioration of the characteristics of the electron emitting device.

Figure 11:
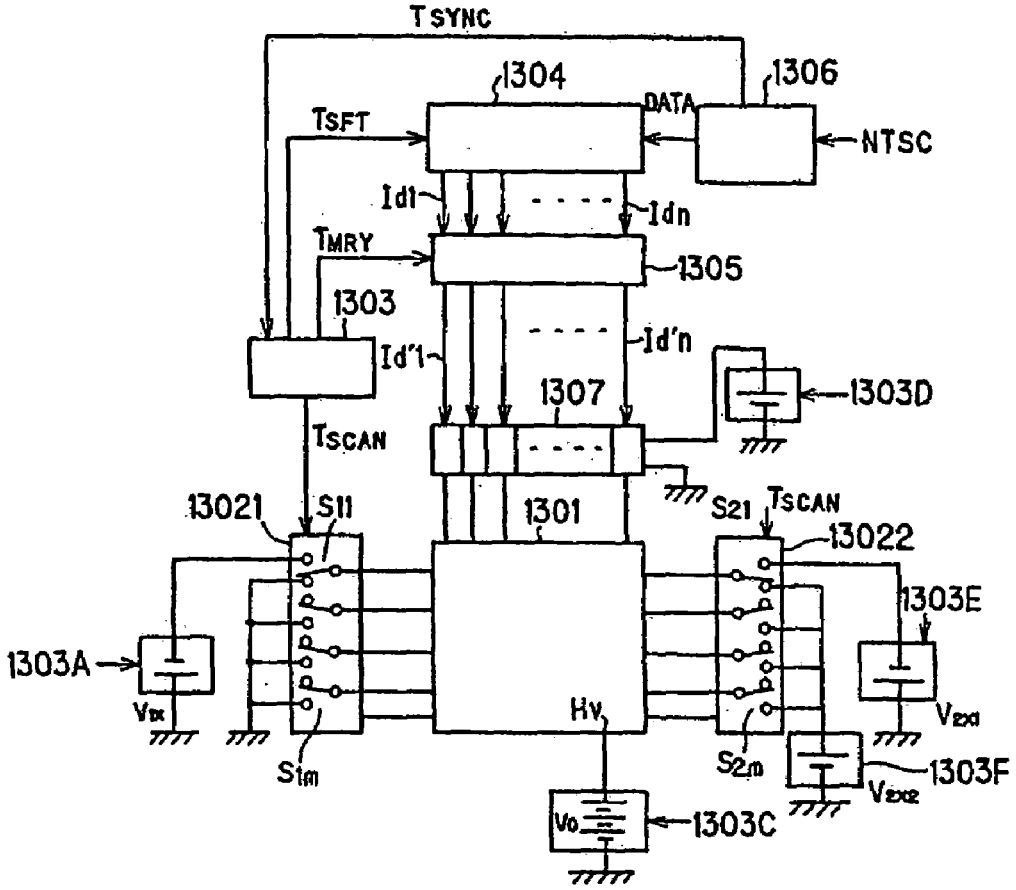
FIG. 11 is a block diagram to describe an arrangement for driving of an image forming apparatus in accordance with the third embodiment of the present invention.

The control of the respective powers as described above can be achieved by controlling the powers in association with each other by the control circuit 1303 shown in FIG. 11 which is operatively connected to the main power switch or the power switch of a remote controller.

Next, one example of a method for manufacturing an electron emitting device in accordance with this embodiment, as shown in FIG. 10, will be described with reference to FIG. 15.

The board 1, the cathode 2, the insulating layer 3 and the gate 4 are formed of the same materials respectively and the same process as in the first embodiment (FIG. 15(*a*)).

Next, a portion of the insulating layer 3 and a portion of the gate 4 are removed from the board 1 by the photolithography technology to form the opening 10 in such a way that the cathode 2 is exposed to the metal back 29 side (FIG. 15(*b*)). At this time, as shown in FIG. 10(*b*), the gate is patterned in such a way as to be separated into the first gate 4 and the second gate 9, whereby the first gate 4 and the second gate 9 are also electrically separated from each other.

The opening 10 formed in this manner, as is the case with the first embodiment, can be formed, for example, in the shape of a hole or a slit as well as a rectangle.

This opening 10 is formed in such a way that the stacked region of the insulating layer 3 and the first gate 4 and the stacke region of the insulating layer 3 and the second gate 9 are arranged around the opening 10. Further, the etching process may be stopped above the cathode 2 and may be stopped after a portion of the cathode 2 is etched off.

The electron emitting element 7 is formed on the cathode 2 in the opening 10 (FIG. 15(*c*)). The electron emitting element 7 can be formed by the same material and the same forming method as in the first embodiment.

Next, the fundamental construction of the image forming apparatus including the display panel and the drive circuit described above will be described with reference to a block diagram shown in FIG. 11.

As shown in FIG. 11, in this embodiment, scanning circuits (scanning signal applying means) 13021, 13022 for selecting the columns of the electron emitting devices 100 arranged in the X direction are connected to the wirings 12 in the X direction. The scanning circuits 13021, 13022 have the same construction as the scanning circuit 1302 described in the first embodiment, respectively. That is, each of them has a switching devices S11 to S1*m* and *m* switching devices S21 to S2*m*. The switching devices S11 to S1*m* are connected to the wirings G11 to G1*m* and the switching devices S21 to S2*m* are connected to the wirings G21 to G2*m*, respectively. Here, the switching devices S1*i* and S2*i* are switched in the same way on the basis of TSCAN outputted from the control circuit 1303. However, in the scanning circuit 13021, the output voltage V1X of the DC voltage source 1303A or 0 V (ground level) is selected by the switching devices S11 to S1*m*. On the other hand, in the scanning circuit 13022, the output voltage V2X1 of a DC voltage source 1303E, the output voltage V2X2 of a DC voltage source 1303F, or 0 V (ground level) is selected by the switching devices S21 to S2*m*.

On the other hand, the modulation signal generator (information signal generating means) 1307 for modulating each column of the electron emitting devices arranged in the Y direction according to an input signal is connected to the wirings 11 in the Y direction.

The other construction is the same as the construction in the image forming apparatus in accordance with the first embodiment.

In this embodiment, the first gate 4 and the second gate 9 are formed on the first insulting layer 3 in such a way that they are electrically separated from each other and different electric potentials are applied to the first gate 4 and the second gate 9 to deflect the orbit of the electrons emitted from the electron emitting element 7, whereby the electron beam can be prevented from colliding with the metal back 29 directly above the electron emitting element 7. With this, it is possible to prevent generated ions from falling onto the electron emitting element 7 and as a result, to reduce the deterioration of the characteristics of the electron emitting device.

Further, according to the method for driving an image forming apparatus in accordance with the invention, it is possible to prevent the display from emitting light abnormally when the power is turned on and/or off.

(Fourth Embodiment)

A display panel 1301 in accordance with the fourth embodiment of the invention will be described with reference to FIG. 26.

The display panel 1301 in accordance with this embodiment is the same as the display panel in accordance with the third embodiment except that a phosphor 28 and black conductive members 30 are arranged on an anode board 27 and the same constituent members are denoted by the same reference numbers. Hereafter, part's different from those in the third embodiment will be described.

Figure 26:
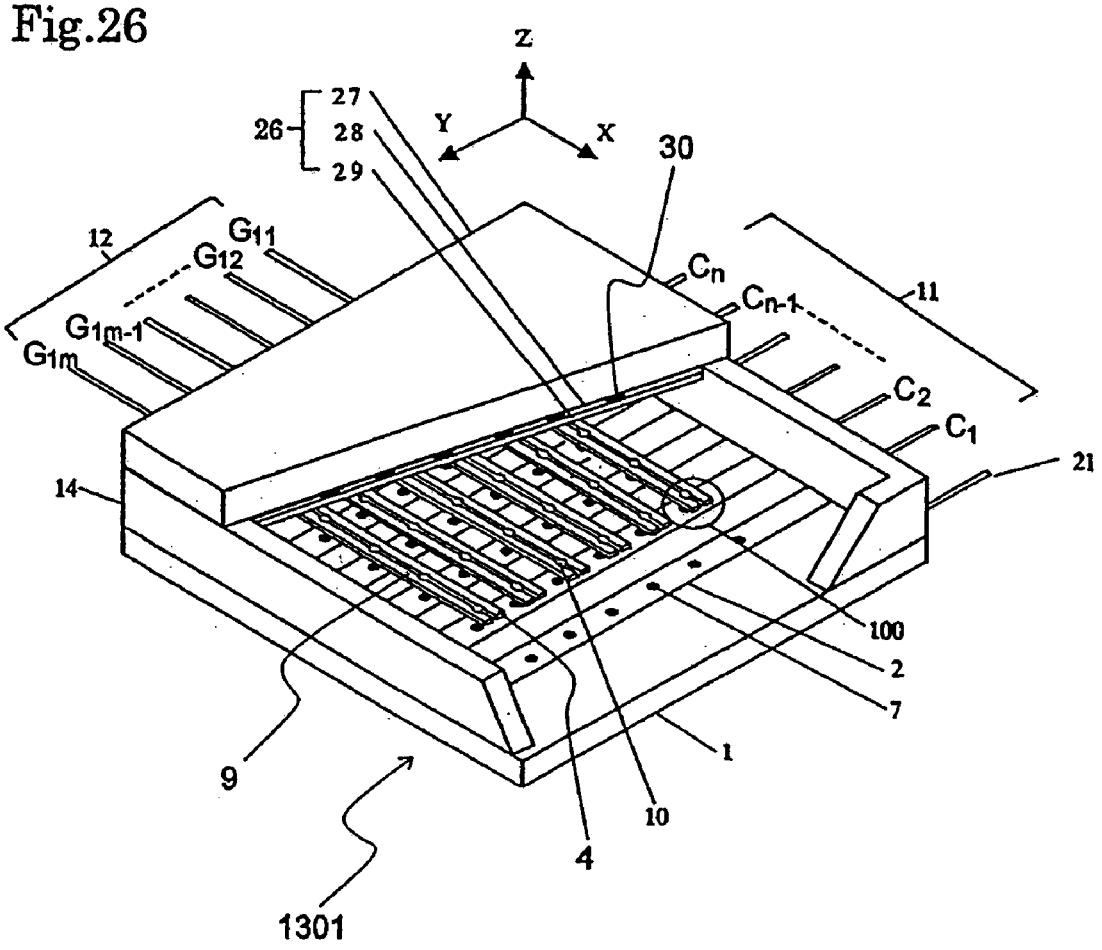
FIG. 26 is a perspective view of a display panel in accordance with the fourth embodiment of the invention.

As shown in FIG. 26, black conductive members 30 called black stripes (black matrix) are formed on the anode board 27 in such a way as to divide the phosphor 28. The black conductive members 30 are members to prevent the formation of an image and even if the electrons emitted and accelerated by the electric potential of the metal back 29 collide with the black conductive members 30, the black conductive members 30 do not emit light. The black conductive members 30 can be formed by etching a black resist applied to the surface of board or a stacked film, which is formed of metal such as chromium or metal oxide on a glass board thereof, in the shape of a pattern.

Figure 16A:
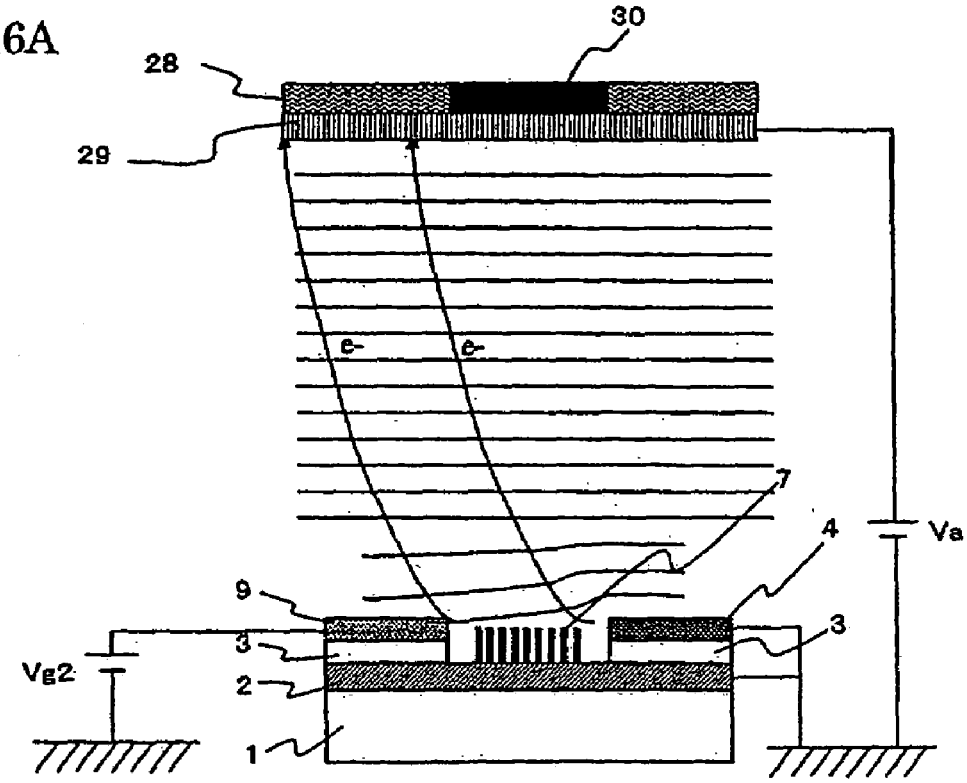
FIG. 16(*a*) is a schematic view to show the ON state of an electron emitting device in accordance with the fourth embodiment of the present invention and FIG. 16B is a schematic view to show a state immediately after power being turned off.

A method for controlling electron emission from the respective electron emitting devices 100 in an image forming apparatus in accordance with this embodiment will be described with reference to FIG. 16.

FIG. 16(*a*) and FIG. 16(*b*) show sectional views of one electron emitting device in the image forming apparatus in accordance with this embodiment. A reference numeral 30 denotes the black conductive member.

FIG. 16(*a*) shows an electric potential distribution and an electron beam orbit in the ON X state of the electron emitting device. FIG. 16(*b*) shows the electric potential distribution and the electron beam orbit immediately after the power of the image forming apparatus being turned off. In the drawing, a reference numeral 28 denotes a phosphor and 30 denotes a black conductive member. An anode board 27 is not shown in the drawing.

The black conductive members 30, as shown in FIG. 16(*a*), are formed in such a way as to divide the phosphor 28. Further, the black conductive members 30 are arranged opposite to the electron emitting elements 7, respectively.

FIG. 16(*a*) shows the ON state where, as is the case with the third embodiment, 10 kV as a voltage Va between metal back and cathode voltage is applied and 0 V is applied to the first gate and an electric potential of 15 V as Vg2 is applied to the second gate. Hence, the electron beam orbit is deflected and hence does not collide with the metal back 29 on the black conductive member 30 located directly above the electron emitting element 7 but collides with the metal back 29 on the phosphor 28 to make the phosphor 28 emit light.

Immediately after the power of the image forming apparatus is turned off, the electric potentials of the first gate 4 and the second gate 9 are brought to 0 V and electric charges charged at high voltage are in the metal back 29, so that the electric potential of the metal back 29 does not drop immediately and hence the metal back 29 emits electrons in some case. In this case, as shown in FIG. 16(*b*), the electron beam orbit goes directly above the electron emitting element 7 and hence the electrons collide with the metal back 29 on the black conductive member 30. Therefore, this can prevent the light emission of the display when the power is turned off.

Figure 17:
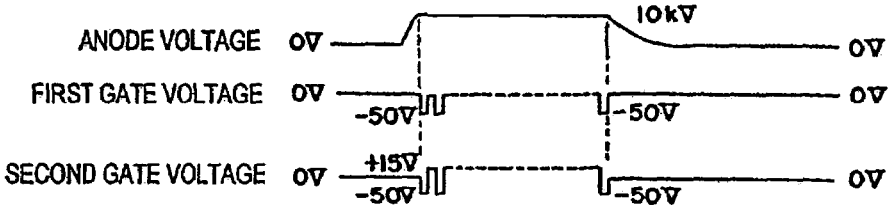
FIG. 17 is a timing chart of a drive voltage in the electron emitting device in accordance with the fourth embodiment of the present invention.

In FIG. 17 is shown a timing chart of the image forming apparatus in accordance with this embodiment.

First, the electric potentials of the first gate 4 and the second gate 9 are changed to −50 V at the same time when an electric potential of the metal back 29 reaches 10 kV. The electric potential of the first gate 4 is changed to 0 V and the electric potential of the second gate 9 is changed to 15 V after the electric potential of the metal back 29 reaches 10 kV. The different electric potential is applied to the first gate 4 and the second gate 9, so that the electron beam orbit emitted from the electron emitting element 7 is deflected and reaches the metal back 29 on the phosphor 28. Further, the electric potentials of the first gate 4 and the second gate 9 are returned from −50 V to 0 V at the same time when the application of the electric potential to the metal back 29 is stopped. With this, even if electrons are emitted when the application of the electric potential to the metal back 29 is started or stopped such as when the power is turned on or off, the electrons reach the metal back 29 on the black conductive member 30, which can prevent the display from emitting light abnormally.

In this embodiment, the black conductive member 30 is arranged directly above the electron emitting element 7 to prevent the electrons emitted directly above the electron emitting element 7 from colliding with the metal back 29 on the phosphor 28. Hence, this can prevent the display from emitting light abnormally when the power is turned on and/or off. Further, as is the case with the third embodiment, the electron beam orbit is deflected to prevent the electrons from colliding with the metal back 29 directly above the electron emitting element 7. With this, it is possible to prevent generated ions from falling onto the electron emitting element 7, which can reduce the deterioration of the characteristics of the electron emitting device.

(Fifth Embodiment)

Figure 18:
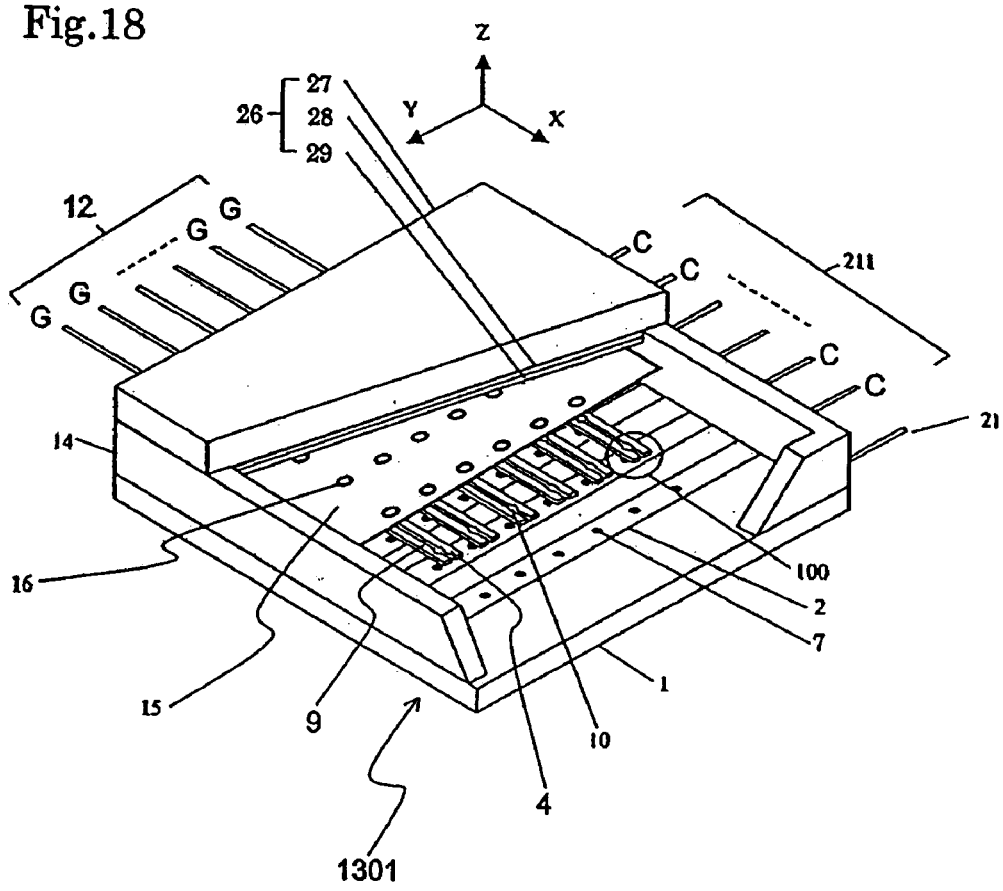
FIG. 18 is a perspective view of a display panel in accordance with the fifth embodiment of the present invention.

A display panel 1301 in accordance with the fifth embodiment of the invention will be described with reference to FIG. 18.

The display panel 1301 in accordance with this embodiment is the same as the display panel in accordance with the third embodiment except that a conductive plate 15 is interposed between the electron emitting element 7 and the metal back 29 and the same constituent members are denoted by the same reference numbers. Further, the construction of the conductive plate 15 is the same as that in the second embodiment.

A method for controlling electron emission from the respective electron emitting devices 100 in an image forming apparatus in accordance with this embodiment will be described with reference to FIG. 19.

FIG. 19(*a*) and FIG. 19 (*b*) show the sectional views, of one electron emitting device 100 in the image forming apparatus in accordance with this embodiment.

FIG. 19(*a*) shows an electric potential distribution and an electron beam orbit in the ON state of the electron emitting device. FIG. 19(*b*) shows the electric potential distribution and the electron beam orbit immediately after the power of the image forming apparatus being turned off.

In the ON state shown in FIG. 19(*a*), 10 kV as an electric potential Va between the metal back and the cathode voltage is applied to the metal back 29 and 0 V is applied to the first gate 4 and an electric potential of 15 V as Vg2 is applied to the second gate 9, whereby electrons are emitted from the electron emitting element 7 and the emitted electrons are affected and deflected by the electric field by the second gate 9. Further, the electrons emitted from the electron emitting element 7 pass through the through holes 16 of the conductive plate 7 interposed between the metal back 29 and the electron emitting element 7 and reach the metal back 29. Since the through hole 16 is formed at a position deviated from directly above the electron emitting element 7, when a deflection electric potential is applied to the deflection electrode 6, the emitted electrons can reach the metal back 29.

Immediately after the power of the image forming apparatus is turned off, the electric potentials of the first gate 4 and the second gate 9 are brought to 0 V and electric charges charged at high voltage are in the metal back 29, so that the electric potential of the metal back 29 does not drop immediately and hence electrons are emitted in some case. In this case, as shown in FIG. 19(*b*), the electron beam orbit goes directly above the electron emitting element 7 and hence electrons collide with the conductive plate 15, which can hence prevent the light emission of the display when the power is turned off.

Figure 20:
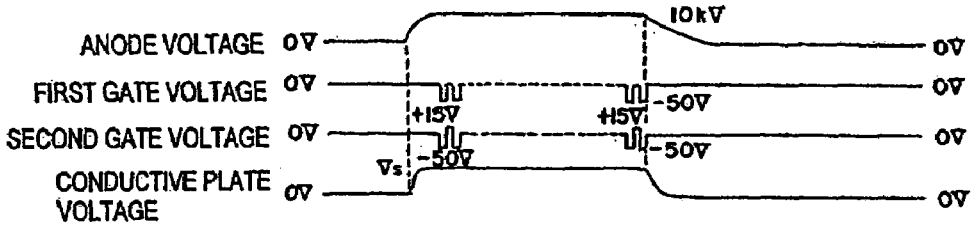
FIG. 20 is a timing chart of a drive voltage in the electron emitting device in accordance with the fifth embodiment of the present invention.

In FIG. 20 is shown a drive voltage timing chart in the electron emitting device in accordance with this embodiment.

First, at the same time when an electric potential of 10 kV is applied to the metal back 29, a predetermined electric potential Vs V is applied also to the conductive plate 15. The predetermined electric potential Vs is equal in polarity to the voltage Va between the metal back and the cathode voltage. Assuming that the distance between the board 1 and the conductive plate 15 is a and that the distance between the metal back 29 and the conductive plate 15 is b, it is preferable that the electric potential Vs to be applied to the conductive plate 15 is made a value of $Vs \cong a/(a+b) \times Va$, not to disturb the electric potential distribution formed by the electric potential applied to the metal back 29.

The electric potential of the first gate 4 is changed to 0V and the electric potential of the second gate 9 is changed to 15 V after the electric potential of the metal back 29 reaches 10 kV. The electric potential of 15 V is applied to the second gate 9, so that the electron beam orbit emitted from the electron emitting element 7 is deflected and passes through the through hole of the conductive plate 15 and reaches the metal back 29.

Further, when the application of the electric potential to the metal back 29 is stopped, the electric potential of the conductive plate 15 is also changed to 0 V. With this, it is possible to prevent the display from being made to emit light abnormally by the emitted electrons when the application of the electric potential to the metal back 29 is started or stopped such as when the power is turned on or off.

In this embodiment, the conductive plate 15 is arranged directly above the electron emitting element 7 to intercept the electrons emitted directly above the electron emitting element 7 to prevent the display from emitting light abnormally when the power is turned on and or off. Further, as is the case with the third embodiment, the electron beam orbit is deflected to prevent the electrons from colliding with the metal back directly above the electron emitting element 7. With this, it is possible to prevent generated, ions from falling onto the electron emitting element 7, which can reduce the deterioration of the characteristics of the electron emitting device.

The invention is not limited to the embodiments described above but the respective constituent elements may be replaced by alternatives and equivalents if they can achieve the object of the invention.

This application claims priority from Japanese Patent Application No. 2003-346270 filed Oct. 3, 2003, which is hereby incorporated by reference herein.

What is claimed is:

1. An image forming apparatus comprising:

a cathode;

a gate;

an anode;

an electron emitting element arranged on the cathode;

an image forming member that is arranged opposite to the electron emitting element and is made to emit light by a collision of an electron, emitted from the electron emitting element by applying an electric field to the electron emitting element, to form an image;

a deflection electrode that deflects an orbit of the electron emitted from the electron emitting element and headed toward the anode; and a driver, wherein assuming that an electric field required to start electron emission from the electron emitting element is Ee, that an electric field applied to the electron emitting element by applying voltage to the anode is Ea and that an electric field applied to the electron emitting element by applying voltage to the gate is Eg, the driver applies voltages to the cathode, the gate, and the anode in such a way that $$Ea>Ee \quad \text{(i)}$$

or $$Ea+Eg>Ee \text{ and } Ea>Eg \quad \text{(ii)}$$

is satisfied.

2. An image forming apparatus as claimed in claim 1, further comprising a member arranged, in opposition to the electron emitting element, on the image forming member to prevent the collision of the electron from forming the image.

3. An image forming apparatus as claimed in claim 1, further comprising an electron intercepting member that is arranged opposite to the electron emitting element to prevent the electron, emitted from the electron emitting element by the electric field applied to the electron emitting element, from reaching the image forming member.

4. An image forming apparatus as claimed in claim 1, wherein the electron emitting element is an element containing carbon.

5. An image forming apparatus as claimed in claim 4, wherein the element containing carbon is made of any one of fullerene, diamond, diamond-like carbon, and carbon fiber.

6. An image forming apparatus as claimed in claim 1, wherein when the driver restrains the electron emission from the electron emitting element, the driver applies voltages to the cathode, the gate, and the anode in such a way that (Ea+Eg<Ee) is satisfied.

7. An image reception display apparatus comprising the image forming apparatus as claimed in claim 1 and a circuit that receives an image signal and generates an image signal to be outputted to the image forming apparatus.

8. An image forming apparatus comprising:

a cathode;

a gate;

an anode;

an electron emitting element arranged on the cathode;

an image forming member that is arranged opposite electron emitting element and is made to emit light by a collision of an electron, emitted from the electron emitting element by applying an electric field to the electron emitting element, to form an image;

a deflection electrode that deflects an orbit of the electron emitted from the electron emitting element and headed toward the anode; and a driver, wherein assuming that an electric field required to start electron emission from the electron emitting element is Ee, that an electric field applied to the electron emitting element by applying voltage to the anode is Ea, that an electric field applied to the electron emitting element by applying voltage to the gate is Eg and that an electric field applied to the electron emitting element by applying voltage to the deflection electrode is Eh, the driver applies voltages to the cathode, the gate, the deflection electrode, and the anode in such a way that $$Ea+Eh>Ee \text{ and } Ea>Eh \quad \text{(i)}$$

or $$Ea+Eg+Eh>Ee \text{ and } Ea>Eg+Eh \quad \text{(ii)}$$

is satisfied.

9. A method for driving an image forming apparatus comprising: a cathode; a gate; an anode; an electron emitting element arranged on the cathode; an image forming member that is arranged opposite to the electron emitting element and is made to emit light by a collision of an electron, emitted from the electron emitting element by applying an electric field to the electron emitting element, to form an image; a deflection electrode that deflects an orbit of the electron emitted from the electron emitting element and headed toward the anode; and a driver, wherein assuming that an electric field required to start electron emission from the electron emitting element is Ee, that an electric field applied to the electron emitting element by applying voltage to the anode is Ea, and that an electric field applied to the electron emitting element by applying voltage to the gate is Eg, the driver applies voltages to the cathode, the gate, and the anode in such a way that (i) Ea>Ee or (ii) Ea+Eg>Ee and Ea>Eg is satisfied, wherein when voltages for emitting the electron from the electron emitting element are applied to the cathode, the gate, and the anode, and/or when power supply is stopped, the deflection electrode deflects the orbit of the electron heading for the anode.

10. A method for driving an image forming apparatus comprising: a cathode; a gate; an anode; an electron emitting element arranged on the cathode; an image forming member that is arranged opposite to the electron emitting element and is made to emit light by a collision of an electron, emitted from the electron emitting element by applying an electric field to the electron emitting element, to form an image; a deflection electrode that deflects an orbit of the electron emitted from the electron emitting element and headed toward the anode; and a driver, wherein assuming that an electric field required to start electron emission from the electron emitting element is Ee, that an electric field applied to the electron emitting element by applying voltage to the anode is Ea and that an electric field applied to the electron emitting element by applying voltage to the gate is Eg, the driver applies voltages to the cathode, the gate, and the anode in such a way that (i) Ea>Ee or (ii) Ea+Eg>Ee and Ea>Eg is satisfied, wherein when voltages for emitting the electron from the electron emitting element are applied to the cathode, the gate, and the anode, and/or when power supply is stopped, a voltage for preventing the electron emission from the electron emitting element is applied to the deflection electrode.

11. A method for driving an image forming apparatus comprising: a cathode; a gate; an anode; an electron emitting element arranged on the cathode; an image forming member that is arranged opposite to the electron emitting element and is made to emit light by a collision of an electron, emitted from the electron emitting element by applying an electric field to the electron emitting element, to form an image; and an electron intercepting member that prevents the electron emitted from the electron emitting element from reaching the image forming member, wherein when voltages for emitting the electron from the electron emitting element are applied to the cathode, the gate, and the anode, a voltage of the same polarity as a voltage between the cathode and the anode is applied between the cathode and the electron intercepting member.

12. A method for driving an image forming apparatus comprising: a cathode; a gate; an anode; an electron emitting element arranged on the cathode; an image forming member that is arranged opposite to the electron emitting element and is made to emit light by a collision of an electron, emitted from the electron emitting element by applying an electric field to the electron emitting element, to form an image; and an electron intercepting member which prevents the electron emitted from the electron emitting element from reaching the image forming member, wherein when voltages for emitting the electron from the electron emitting element are applied to the cathode, the gate, and the anode, and/or when power supply is stopped, an electric potential of the electron intercepting member is made a value at which the electron emitted from the electron emitting element is prevented from reaching the anode.

* * * * *

UNITED STATES PATENT AND TRADEMARK OFFICE

CERTIFICATE OF CORRECTION

PATENT NO. : 7,135,823 B2
APPLICATION NO. : 10/954206
DATED : November 14, 2006
INVENTOR(S) : Noritake Suzuki It is certified that error appears in the above-identified patent and that said Letters Patent is hereby corrected as shown below:

COLUMN 1:

Line 40, “diamond” (second occurrence) should read --diamond- --;
Line 57, “FIG 27(b)” should read --FIG. 27B--; and
Line 64, “FIG. 27(b),” should read --FIG. 27B,--.

COLUMN 2:

Line 29, “Further” should read --Further,--.
Line 31, “sufficient” should read --sufficiently--.
Line 59, “an cathode;” should read --an anode;--.

COLUMN 3:

Line 15, “an cathode” should read --an anode--; and
Line 55, “gate an” should read --gate; an--.

COLUMN 4:

Line 4, “are” should read --is--;
Line 6, “are” should read --is--;
Line 22, “FIG. 4(b)” should read --FIG. 4B--;
Line 35, “FIG. 8” should read --FIGS. 8A, 8B and 8C--;
Line 41, “FIG. 10(a)” should read --FIG. 10A--;
Line 53, “FIG. 13” should read --FIGS. 13A, 13B, 13C and 13D--;
Line 59, “FIG. 15” should read --FIGS. 15A, 15B and 15C--; and
Line 63, “FIG. 16(a)” should read --FIG. 16A--.

Figure 19A:
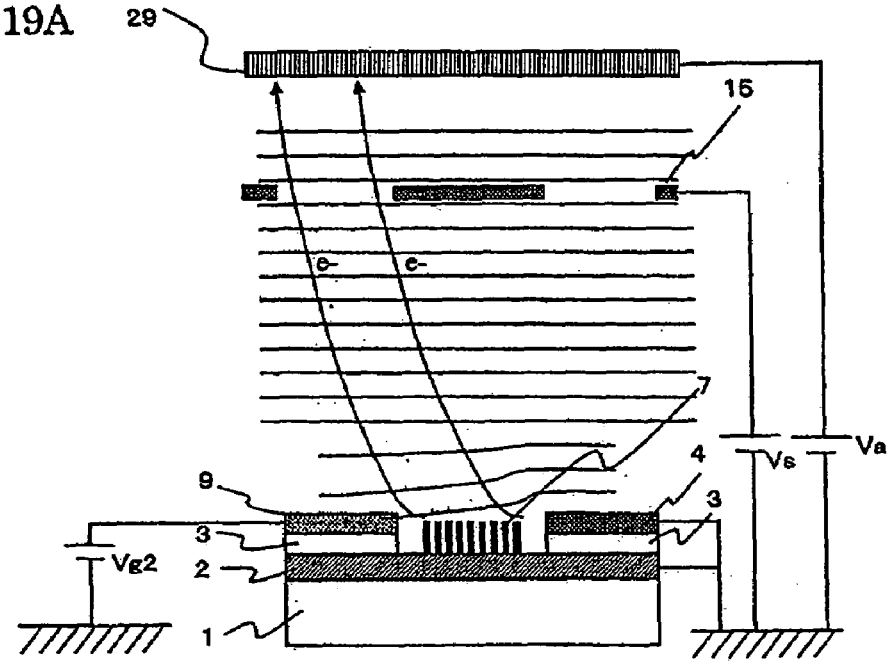
FIG. 19(*a*) is a schematic view to show the ON state of an electron emitting device in accordance with the fifth embodiment of the present invention and FIG. 19B is a schematic view to show a state immediately after power being turned off.

COLUMN 5:

Line 7, “FIG. 19(a)” should read --FIG. 19A--;
Line 15, “FIG. 21(a)” should read --FIG. 21A--;
Line 17, “FIG. 21(b)” should read --FIG. 21B--;
Line 19, “FIG. 21(a)” should read --FIG. 21A--;
Line 20, “FIG. 21(c)” should read --FIG. 21C--;
Line 22, “FIG. 21(b)” should read --FIG. 21B.--;
Line 23, “FIG. 22(a)” should read --FIG. 22A--;
Line 25, “FIG. 22(b)” should read --FIG. 22B--;
Line 27, “FIG. 22(a),” should read --FIG. 22A,--;
Line 28, “FIG. 22(c) and FIG. 22(d)” should read --FIG. 22C and FIG. 22D--;
Line 30, “FIG. 22(b).” should read --FIG. 22B.--;

UNITED STATES PATENT AND TRADEMARK OFFICE

CERTIFICATE OF CORRECTION

Figure 27A:
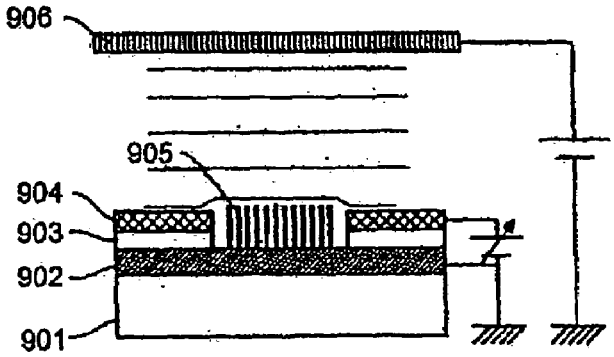
FIG. 27(*a*) is a schematic view to show an ON state in a conventional electron emitting device and FIG. 27(*b*) is a schematic view to show an OFF state.
Figure 27B:
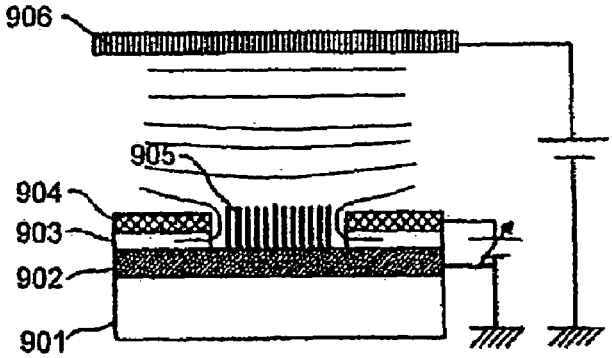
PRIOR ART Fig.27B

PATENT NO. : 7,135,823 B2
APPLICATION NO. : 10/954206
DATED : November 14, 2006
INVENTOR(S) : Noritake Suzuki It is certified that error appears in the above-identified patent and that said Letters Patent is hereby corrected as shown below:

COLUMN 5 (cont"d):

Line 42, "FIG. 27(a)" should read --FIG. 27A--; and
Line 43, "FIG. 27(b)" should read --FIG. 27B--.

Figure 4A:
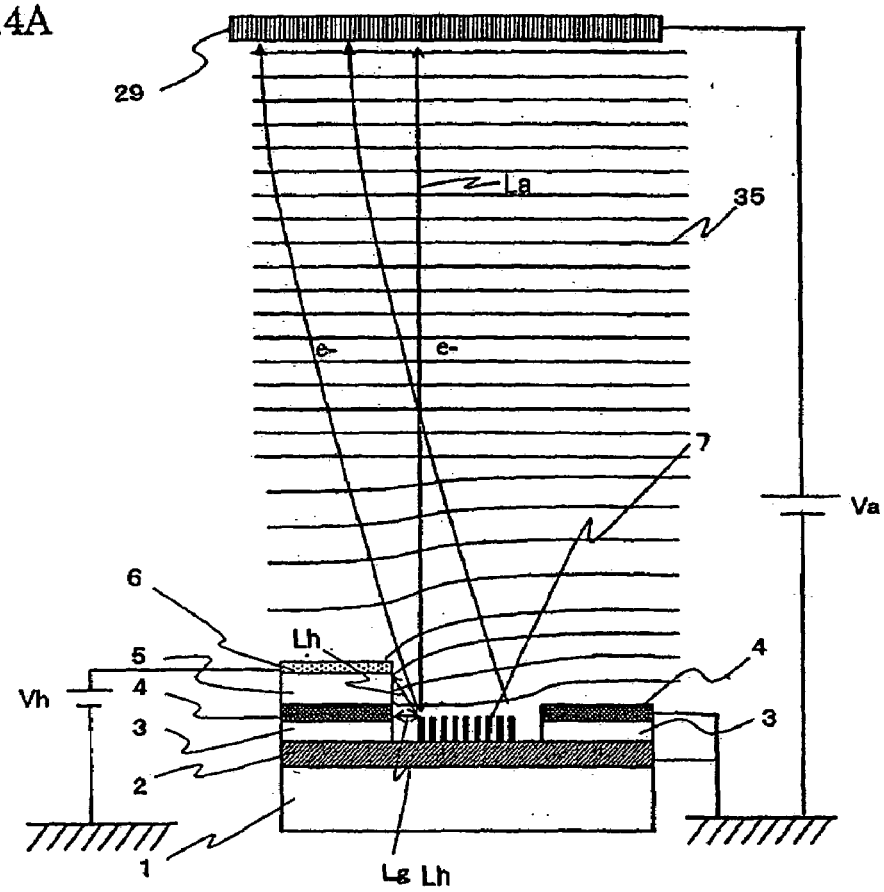
FIG. 4A is a schematic view to show the ON state of an electron emitting device in accordance with the first embodiment of the present invention and FIG. 4(*b*) is a schematic plan view to show the structure of the electron emitting device in accordance with the first embodiment of the present invention.
Figure 4B:
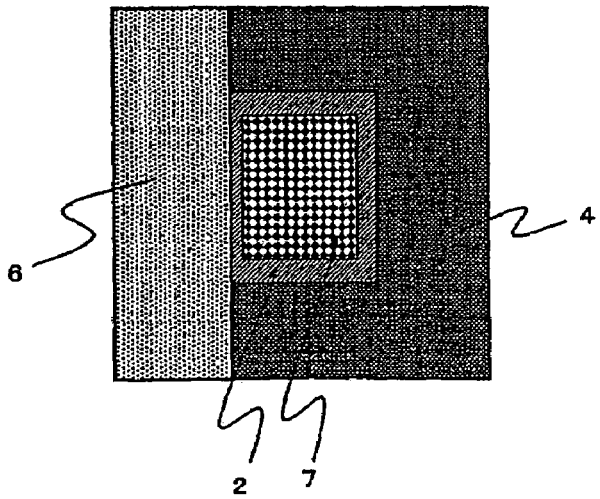

COLUMN 6:

Line 66, "FIG. 4(b). FIG. 4(a)" should read --FIG. 4B. FIG. 4A--; and
Line 67, "FIG. 4(a)" should read --FIG. 4A--.

COLUMN 7:

Line 2, "FIG. 4(b)" should read --FIG. 4B--; and
Line 15, "FIG. 4(a)" should read --FIG. 4A--.

COLUMN 8:

Line 22, "FIG. 4(a)" should read --FIG. 4A--; and
Line 24, "FIG. 4(a)" should read --FIG. 4A--.

COLUMN 9:

Line 53, "control led" should read --controlled--.

COLUMN 10:

Line 9, "FIG. 4(a) and FIG. 4(b)," should read --FIG. 4A and FIG. 4B,--;
Line 24, "Zrc," should read --ZrC,--;
Line 25, "HfB2, ZrB2, LaB6," should read --$HfB_2$, $ZrB_2$, $LaB_6$,--;
Line 26, "CeB6, YB4, and GdB4;" should read --$CeB_6$, $YB_4$, and $GdB_4$--;
Line 35, "SiO2, SiN, Al2O3," should read --$SiO_2$, SiN, $Al_2O_3$,--;
Line 45, "Zrc," should read --ZrC,--;
Line 46, "Sic," should read --SiC,--; and "HfB2, ZrB2, LaB6, CeB6," should read --$HfB_2$, $ZrB_2$, $LaB_6$, $CeB_6$,--;
Line 47, "YB4, and GdB4;" should read --$YB_4$, and $GdB_4$;--; and
Line 60, "(FIG. 8(b))." should read --(FIG. 8A).--.

UNITED STATES PATENT AND TRADEMARK OFFICE

CERTIFICATE OF CORRECTION

PATENT NO. : 7,135,823 B2
APPLICATION NO. : 10/954206
DATED : November 14, 2006
INVENTOR(S) : Noritake Suzuki It is certified that error appears in the above-identified patent and that said Letters Patent is hereby corrected as shown below:

COLUMN 11:

Line 1, "1," should read --1--;
Line 2, "(FIG. 8(b))." should read --(FIG. 8B).--;
Line 18, "(FIG. 8(c))." should read --(FIG. 8C).--;
Line 19, "can be used" should read --to be used can be--;
Line 30, "can," should read --can--;
Line 31, "be used" should read --use--;
Line 45, "of" should read --or--; and
Line 62, "In the" should read --In--.

Figure 22A:
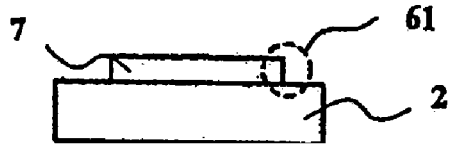
FIG. 22(*a*) is a schematic view to show a bonding portion of a cathode and an electron emitting element in an image forming apparatus of the invention and FIG. 22(*b*) is a schematic enlarged view of the bonding portion of the cathode and the electron emitting element in FIG. 22(*a*), and FIG. 22(*c*) and FIG. 22(*d*) are schematic enlarged views of the vicinity of the tips of carbon fibers constructing the electron emitting element in FIG. 22(*b*).

COLUMN 12:

Line 56, "of," should read --of--; and
Line 65, "FIG. 21(a) and FIG. 22(a)" should read --FIG. 21A and FIG. 22A--.

Figure 22B:
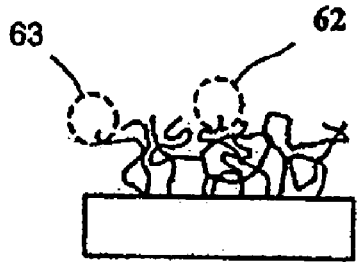
Figure 22C:
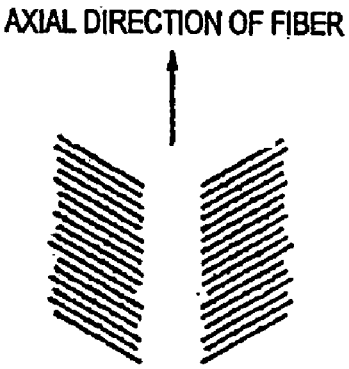
Figure 22D:
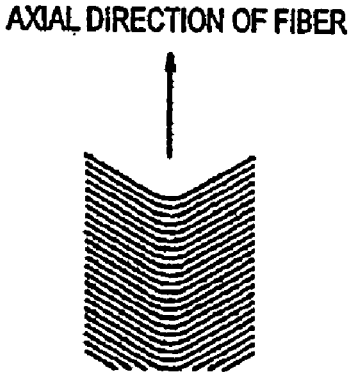

COLUMN 13:

Line 1, "FIG. 21(b)" should read --FIG. 21B--;
Line 2, "22(b)" should read --22B--;
Line 4, "21(b)" should read --21B--; and "FIG. 21(a)." should read --FIG. 21A.--;
Line 5, "FIG. 22(b)" should read --FIG. 22B--;
Line 6, "FIG. 22(a). FIG. 21(b) and FIG. 22(b)" should read --FIG. 22A. FIG. 21B and FIG. 22B--;
Line 8, "FIG. 21(a) and FIG. 22(a)" should read --FIG. 21A and FIG. 22A--;
Line 9, "FIG. 21(c), FIG. 22(c)" should read --FIG. 21C, FIG. 22C--;
Line 10, "22(d)" should read --22D--;
Line 12, "FIG. 21(b)" should read --FIG. 21B.--;
Line 13, "FIG. 22(c) and FIG. 22(d)" should read --FIG. 22C and FIG. 22D--; and
Line 51, "Further" should read --Further,--.

COLUMN 14:

Line 29, "in" should read --in- --;
Line 61, "a" should read --as a--; and
Line 67, "signal." should read --signal--.

UNITED STATES PATENT AND TRADEMARK OFFICE

CERTIFICATE OF CORRECTION

PATENT NO. : 7,135,823 B2
APPLICATION NO. : 10/954206
DATED : November 14, 2006
INVENTOR(S) : Noritake Suzuki It is certified that error appears in the above-identified patent and that said Letters Patent is hereby corrected as shown below:

COLUMN 15:

Line 11, "necessary" should read --necessary.--.

Figure 10A:
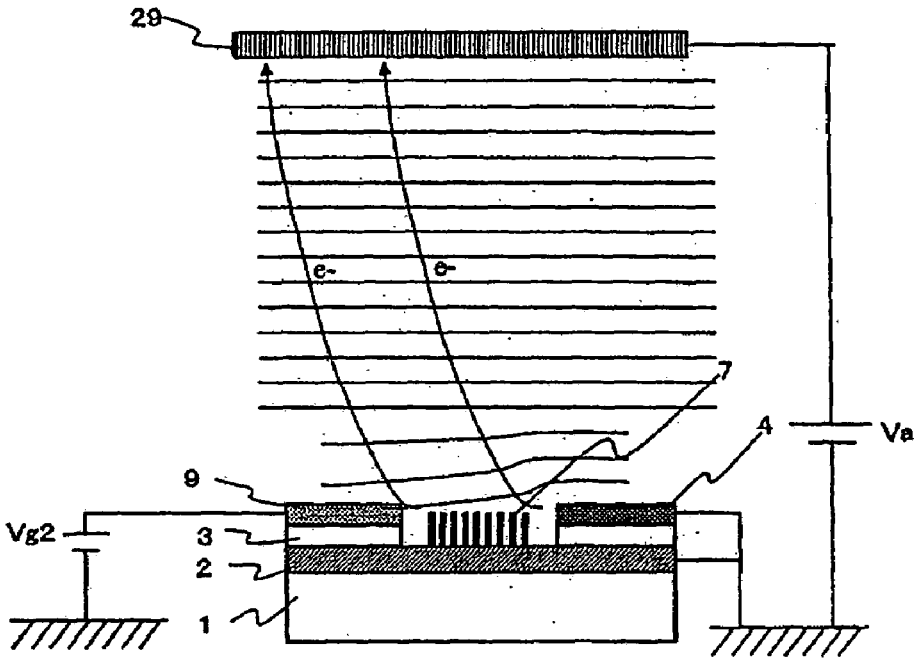
FIG. 10(*a*) is a schematic view to show the ON state of an electron emitting device in accordance with the third embodiment of the present invention and FIG. 10B is a schematic plan view to show the structure of the electron emitting device in accordance with the third embodiment of the present invention.
Figure 10B:
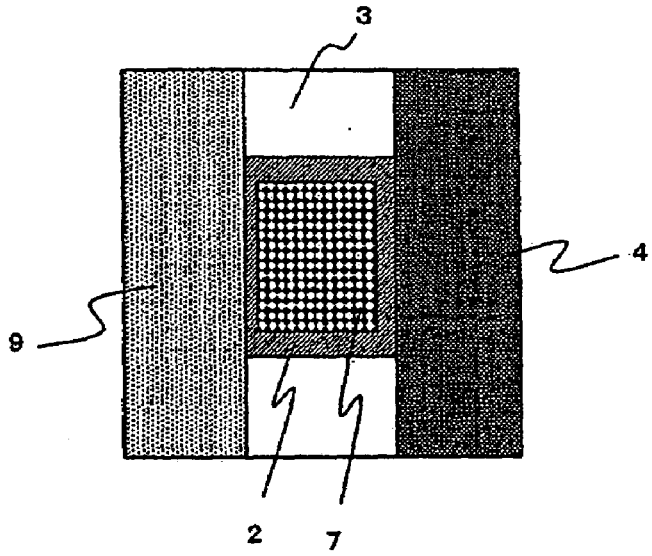

COLUMN 17:

Line 45, "FIG. 10(a)" should read --FIG. 10A--;
Line 47, "FIG. 10(b)" should read --FIG. 10B--; and
Line 51, "FIG. 10(a)" should read --FIG. 10A--.

COLUMN 18:

Line 8, "FIG. 10(a)" should read --FIG. 10A--;
Line 35, "driving," should read --driving--; and
Line 39, "10kV," should read --10kV--.

Figure 15A:
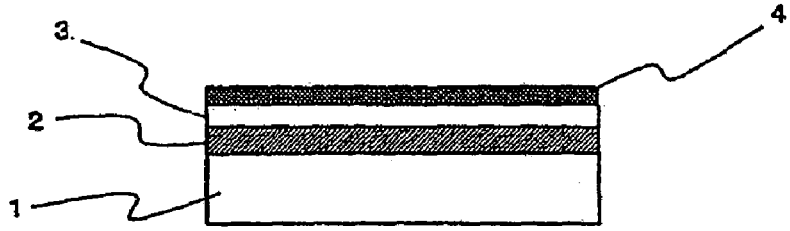
FIG. 15 is a schematic view to show a manufacturing process of the electron emitting device in accordance with the third embodiment of the present invention.
Figure 15B:
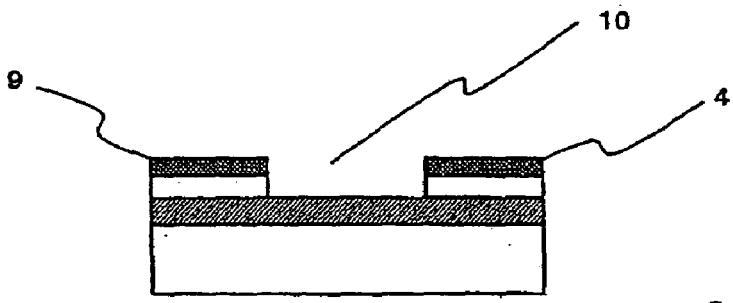
Figure 15C:
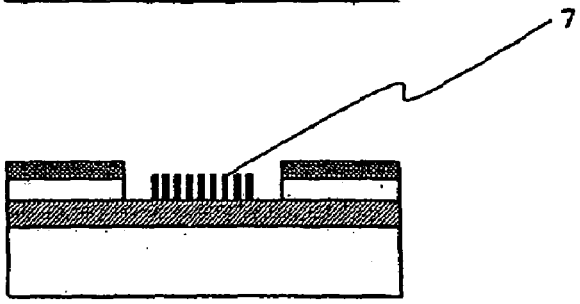

COLUMN 19:

Line 14, "(FIG. 15(a))." should read --(FIG. 15A).--;
Line 19, "15(b))." should read --15B).--; and "FIG. 10(b)," should read --FIG. 10B,--;
Line 29, "stacke" should read --stacked--;
Line 34, "(FIG. 15(c))." should read --(FIG. 15C).--; and
Line 48, "a switching" should read --m switching--.

COLUMN 20:

Line 5, "insulting" should read --insulating--;
Line 47, "FIG. 16(a) and FIG. 16(b)" should read --FIG. 16A and FIG. 16B--;
Line 51, "FIG. 16(a)" should read --FIG. 16A--;
Line 52, "X" should be deleted;
Line 53, "FIG. 16(b)" should read --FIG. 16B--;
Line 61, "16(a)," should read --16A,--; and
Line 64, "FIG. 16(a)" should read --FIG. 16A--.

Figure 16B:
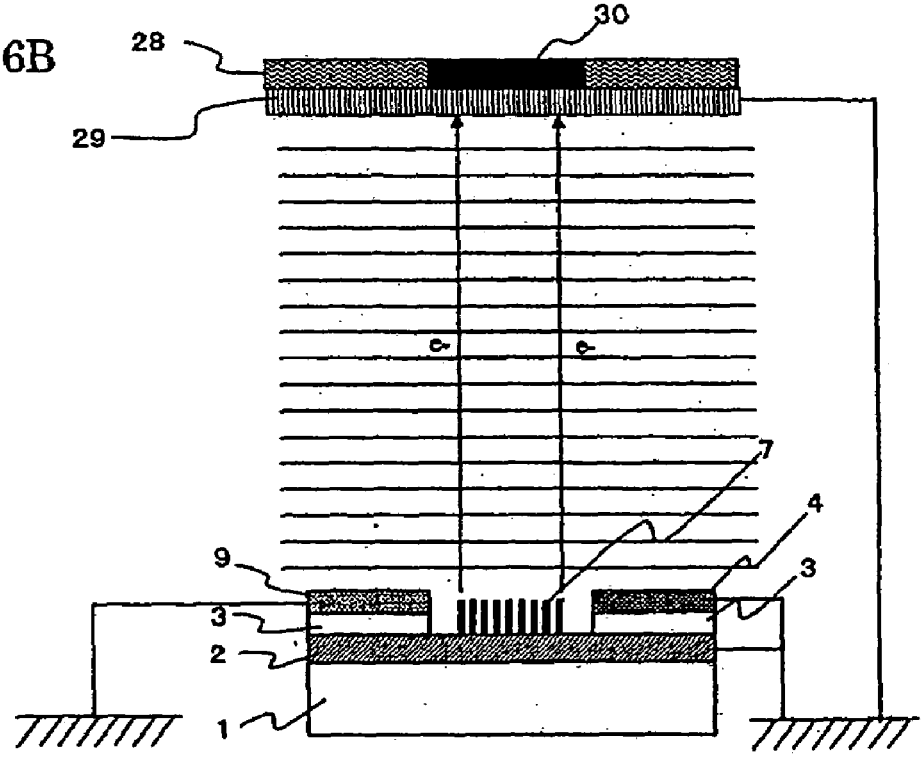

COLUMN 21:

Line 13, "FIG. 16(b)," should read --FIG. 16B,--.

UNITED STATES PATENT AND TRADEMARK OFFICE

CERTIFICATE OF CORRECTION

Figure 19B:
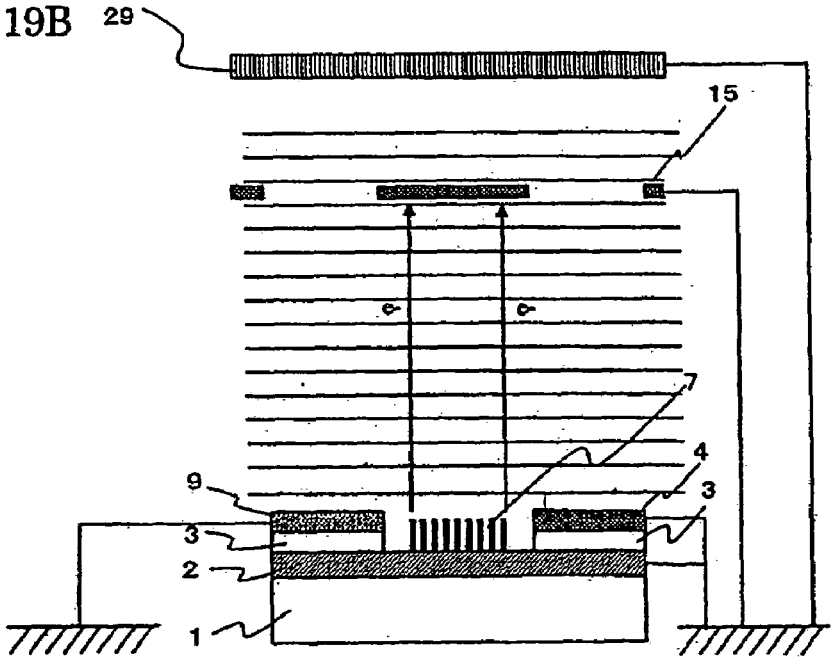

PATENT NO. : 7,135,823 B2
APPLICATION NO. : 10/954206
DATED : November 14, 2006
INVENTOR(S) : Noritake Suzuki It is certified that error appears in the above-identified patent and that said Letters Patent is hereby corrected as shown below:

COLUMN 22:

Line 3, "FIG. 19(a) and FIG. 19(b)" should read --FIG. 19A and FIG. 19B--;
Line 6, "FIG. 19(a)" should read --FIG. 19A--;
Line 8, "FIG. 19(b)" should read --FIG. 19B--;
Line 11, "FIG. 19(a)," should read --FIG. 19B,--;
Line 20, "plate 7" should read --plate 15--; and
Line 33, "FIG. 19(b)," should read --FIG. 19B,--.

COLUMN 23:

Line 9, "generated," should read --generated--.

Signed and Sealed this

Third Day of July, 2007

JON W. DUDAS
*Director of the United States Patent and Trademark Office*